US012546127B2

(12) United States Patent
Routh et al.

(10) Patent No.: US 12,546,127 B2
(45) Date of Patent: Feb. 10, 2026

(54) GRID BEAM SYSTEM FOR SLAB FORMWORK

(71) Applicant: PERI SE, Weissenhorn (DE)

(72) Inventors: Anibrata Routh, Mumbai (IN); K. S. Arun, Mumbai (IN); CNVS Rao, Mumbai (IN); A. Sharanappa, Mumbai (IN); Ankush Rathod, Mumbai (IN)

(73) Assignee: PERI SE, Weissenhorn (DE)

( * ) Notice: Subject to any disclaimer, the term of this patent is extended or adjusted under 35 U.S.C. 154(b) by 0 days.

(21) Appl. No.: 18/294,618

(22) PCT Filed: Aug. 3, 2022

(86) PCT No.: PCT/IB2022/057182
§ 371 (c)(1),
(2) Date: Feb. 2, 2024

(87) PCT Pub. No.: WO2023/012675
PCT Pub. Date: Feb. 9, 2023

(65) Prior Publication Data

US 2024/0344342 A1 Oct. 17, 2024

(30) Foreign Application Priority Data

| | | |
|---|---|---|
| Aug. 3, 2021 | (IN) | 202111034969 |
| Oct. 29, 2021 | (IN) | 202111049578 |
| Mar. 1, 2022 | (IN) | 202211011077 |

(51) Int. Cl.
*E04G 11/48* (2006.01)
*E04G 11/50* (2006.01)

(52) U.S. Cl.
CPC ..... *E04G 11/486* (2013.01); *E04G 11/50* (2013.01)

(58) Field of Classification Search
CPC ..... E04G 11/38; E04G 11/48; E04G 11/486; E04G 11/50; E04G 11/52; E04G 11/483;
(Continued)

(56) References Cited

U.S. PATENT DOCUMENTS 3,397,858 A * 8/1968 Williams ..... E04G 11/50 248/214
3,430,910 A * 3/1969 Bowden ..... E04G 25/065 249/210
(Continued)

FOREIGN PATENT DOCUMENTS

CA 3030905 A1 7/2020
DE 2927116 A * 1/1981 ..... E04G 11/486
(Continued)

*Primary Examiner* — Kyle J. Walraed-Sullivan
(74) *Attorney, Agent, or Firm* — SLEMAN & LUND LLP

(57) ABSTRACT

A grid beam slab formwork comprising of primary beams, secondary beams, multi-level drophead unit, and props. The multi-level drophead unit offers up to or more than six connection points for the primary beams and the secondary beams. The multi-level drophead unit allows the construction of an additional structure that otherwise requires a separate drophead or an adaptor thereby reducing an overall cost associated with the formwork. Moreover, the multi-level drophead unit enables the creation of the platform wherever needed. On the other hand, the adapter prevents entrapment of the sheathing members, such that the beams can be removed when the concrete has achieved required strength and the load can be taken by the props.

9 Claims, 38 Drawing Sheets

(58) Field of Classification Search
CPC ..... E04G 2025/006; E04B 2005/173; E04B 2005/176; E04B 2005/322
See application file for complete search history.

(56) References Cited

U.S. PATENT DOCUMENTS

| | | | | |
|---|---|---|---|---|
| 10,053,875 | B1 * | 8/2018 | Baron | E04G 11/50 |
| 10,407,925 | B2 | 9/2019 | Baron | |
| 11,952,789 | B1 * | 4/2024 | Bond | E04G 11/50 |
| 12,264,486 | B1 * | 4/2025 | Bond | E04G 11/50 |
| 2004/0075042 | A1 * | 4/2004 | Arozena Bergaretxe | E04G 11/486 249/28 |
| 2007/0209297 | A1 * | 9/2007 | Schwoerer | E04G 11/50 52/127.1 |
| 2009/0294627 | A1 * | 12/2009 | Schwoerer | E04G 11/483 249/18 |
| 2010/0044548 | A1 * | 2/2010 | Schwoerer | E04G 11/483 52/127.2 |
| 2014/0374568 | A1 * | 12/2014 | Amon | E04G 17/0652 249/1 |
| 2016/0060882 | A1 * | 3/2016 | Bond | E04G 25/065 249/13 |
| 2017/0275902 | A1 * | 9/2017 | Faresin | E04G 11/38 |
| 2018/0340342 | A1 * | 11/2018 | Lizarazu Zaldua | E04G 11/38 |
| 2019/0010716 | A1 * | 1/2019 | Baron | E04G 25/061 |
| 2019/0010717 | A1 * | 1/2019 | Baron | E04G 11/52 |
| 2019/0063086 | A1 * | 2/2019 | Uribeetxebarria Zubia | E04G 11/52 |
| 2019/0071885 | A1 * | 3/2019 | Faresin | E04G 11/486 |
| 2019/0078340 | A1 * | 3/2019 | Faresin | E04G 11/48 |
| 2019/0145115 | A1 * | 5/2019 | Bacon | E04G 25/08 52/127.2 |
| 2019/0194961 | A1 * | 6/2019 | Bond | E04G 25/061 |
| 2019/0277044 | A1 * | 9/2019 | Faresin | E04G 11/486 |
| 2020/0173183 | A1 * | 6/2020 | Routh | E04G 11/38 |
| 2020/0217091 | A1 * | 7/2020 | Haeberle | E04G 11/38 |
| 2021/0079670 | A1 * | 3/2021 | Becker | E04G 11/38 |
| 2022/0034103 | A1 * | 2/2022 | Bond | E04G 17/04 |
| 2023/0012935 | A1 * | 1/2023 | Poon | E04G 25/065 |
| 2023/0243166 | A1 * | 8/2023 | Faresin | E04G 11/48 248/351 |
| 2023/0323683 | A1 * | 10/2023 | Bacon | E04G 11/486 249/18 |
| 2024/0052650 | A1 * | 2/2024 | Dalla Fontana | E04G 11/486 |

FOREIGN PATENT DOCUMENTS

| | | | | |
|---|---|---|---|---|
| DE | 102015223772 | A1 | 6/2017 | |
| EP | 1944430 | A2 | 7/2008 | |
| EP | 3202998 | A1 | 8/2017 | |
| EP | 3202998 | B1 | 5/2018 | |
| EP | 3719236 | A1 | 10/2020 | |
| EP | 3798387 | A1 | 3/2021 | |
| GB | 1457136 | A | 12/1976 | |
| GB | 2262562 | A | 6/1993 | |
| KR | 2006033882 | A * | 4/2006 | E04G 11/486 |
| WO | 2011089148 | A1 | 7/2011 | |
| WO | 2016030557 | A1 | 3/2016 | |
| WO | 2021105148 | A1 | 6/2021 | |

* cited by examiner

View-3

Detail of 116

100

GRID BEAM SYSTEM FOR SLAB FORMWORK

FIELD OF THE INVENTION

The present disclosure relates to a grid beam slab formwork system comprising of primary beams, secondary beams, dropheads, drophead adaptors, adaptors fixed to secondary beams, closure beams and props.

BACKGROUND

Formwork or shuttering is a temporary mould for concrete to create a pre-defined structure, such as a column, wall or roof. One type of formwork for the manufacturing of horizontal construction elements, such as roof is known as the slab formwork. The slab formwork is formed as a grid by combining four peripheral beams which can be either primary or secondary beams that are joined together to form the periphery of the grid and are supported on dropheads fixed to the props and the props sufficiently braced below as per requirement. The grid also includes a plurality of secondary beams coupled to the opposite facing peripheral beams. Plywood is fixed on the top to form a flat structure onto which the concrete may be poured. During its operation, the formwork is kept assembled until the required concrete strength is achieved.

Conventionally, the dropheads are configured to allow connection with four peripheral beams, such that the drophead acts as a juncture for the grids. There are various limitations associated with the current drophead connecter. For instance, the conventional drophead is configured to allow the mounted four beams at the same level thereby limiting the type of structure that can be created. On the other hand, in a case where a separate structure such as a platform for an operator as a working space; or a cantilever section is to be constructed using the same type of dropheads, then either additional dropheads and special secondary beams are required to form separate grids or drophead attachments along with special secondary beams would be required to manage the level differences, thereby increasing the infrastructural cost of the formwork. Further, the use of additional formwork warrants more time to assemble the formwork thereby delaying the construction of the concrete structure. Moreover, the use of multiple dropheads increases the complexity of the formwork rendering it more prone to failure.

Another limitation of the present systems is that the cantilever and standard grids warrant the use of different formwork elements.

Another limitation is that the plywood gets trapped during the period for which the structure is completed in the early striking scenario till it is allowed to de-shutter the formwork.

Yet another limitation is that the primary beam secondary beam requires to be secured against uplift to not allow it to get dislodged during execution.

Yet another limitation is that the primary beam and the secondary beam has different latching mechanism that warrant separate locking mechanisms which increases an overall cost of manufacturing and maintaining such an inventory. Moreover, installing the secondary beam to the primary beam is a time-consuming process with specialized tools are needed to connect the primary beam to the secondary beam.

SUMMARY

This summary is provided to introduce a selection of concepts, in a simplified format, that are further described in the detailed description of the invention. This summary is neither intended to identify key or essential inventive concepts of the invention and nor is it intended for determining the scope of the invention.

The present disclosure relates to the aspects of a grid beam slab formwork system comprising of primary beams, secondary beams, and multi-level drophead units which can be used for early de-shuttering. The primary and secondary beams are provided with end hooks with a double-walled construction with a cavity in between for latching on to the drophead. The drophead has got multiple fly-plates at various levels which comprises of attachment portions which goes into the cavity of the double-walled end hooks of the primary and/or secondary beams. This enables easy mounting and dismounting of the primary and the secondary beams. The hooks of the drophead flyplate prevent the tilting of the primary beam and the secondary beam when installed. Moreover, the drophead has a stabilizer tube which butt against the end hooks which prevents swaying of the grid consisting of the primary beam and the secondary beam.

In an embodiment, a multi-level drophead unit for a formwork having a standard grid and a cantilever grid formed by coupling primary beams and secondary beams is disclosed. The multi-level drophead unit includes a base plate, a stem attached orthogonal to the base plate; and a flyplate slidably mounted on the stem. The fly plate includes a pair of first attachment portions adapted to receive one of a primary beam and a secondary beam. Further, the flyplate includes second attachment portions and third attachment portions adapted to receive one of the primary beam and the secondary beam. In one example, the pair of first attachment portions and the second attachment portions are co-planar at a first level, and the third attachment portions are positioned at a second level.

In an embodiment, a formwork is disclosed that includes a plurality of props, a plurality of primary beams and a plurality of secondary beams. The formwork also includes a plurality of multi-level drophead units mounted on the plurality of props and adapted to couple to at least one of the plurality of primary beams and the plurality of secondary beams to form a first grid and a second grid, each multi-level drophead unit comprising a base plate coupled to the prop, a stem attached orthogonally to the base plate, a flyplate slidably mounted on the stem. The flyplate comprises a pair of first attachment portions adapted to receive one of a primary beam and a secondary beam, a pair of flanges having second attachment portions and a third attachment portion adapted to receive one of the primary beam and the secondary beam, wherein the pair of first attachment portions and the pair of second attachment portions are coplanar at a first level and the pair of third attachment portion are positioned at a second level.

In an embodiment, a multi-level drophead unit is disclosed. Unlike the conventional dropheads, the six connection points of the drophead enables to form both standard grids and cantilever grids using the same components at different levels. The drophead fly plate is designed in such a way that the primary beams can be connected at two different levels, thus enabling the usage of the same secondary beam in both standard and cantilever grids. In one example, the spacing between the two levels may be equal to the depth of the secondary beam. The drophead unit has six attachment portions, four on the top flyplate and remaining two on the lower level flyplate. Further, the hooks provide an interfering area to prevent tilting of the primary beam and the secondary beam attached thereto. Moreover, the drophead unit has a stabilizer tube which butt against the end hooks of the primary beam or secondary beam to prevent swaying of the primary beam and the secondary beam with respect to the drophead unit, thereby stabilising the grid.

In one example, the body of the primary beam have top surface with two downward lips and two bottom upward lips on their sides creating cavities which enables them to accommodate the connection of self-rotational locking hook of secondary beams and secure against dislodging and uplift as well as double-walled end hook of another primary beam. The primary beam has specially designed end connections with double-walled end hooks that can get fixed to the drophead or the lips of another primary beam and can be erected safely from the level below by hooking them to the drophead or another primary beam. Also, the double walled end hook is swung to snugly fit the hook of the drophead into its cavity and centrally align the beam with the grid axis and to prevent lateral tilting of the primary beam. The hook is designed in such a way that it will not fall during erection and remains stable in the inclined position during safe erection from level below. Once the beam is swung up into position, a front wall of the double walled end hook will abut against the stabilising tube of the drophead which gives stability for the grid against sway. The primary beam also has a bottom groove for accommodating the connection with other accessories like t-bolts etc.

In an embodiment, the secondary beam can be made out of an aluminium extruded profile with specially designed end hooks. It could also be made of a steel sheet bent to the profiled shape. Keeping the same end connection intact owing to its special geometry, the secondary beam could also be formed out of, polymer or timber girders by replacing the aluminium extruded profile to any customised length as required. The secondary beam has specially designed end hooks on both sides which makes the beam self-rotated into a locking position when hooked into the lips of the primary beam. It can be safely erected from the level below using a shuttering aid without tilting or toppling from its position. The specially designed end hooks helps to hook the secondary beams on to the lips of the primary beams. When secondary beam is swung horizontally on to the opposite primary beam, the beam automatically rotates down from horizontal to vertical position due to its self-weight. Once the beam is in vertical position, the end hook gets locked into the cavity of the primary beam and is restrained against accidental dislodging and uplift. The secondary beam can also be connected to a drophead as the end hook is also having a double-walled cavity which snugly fits into the hook plates of the drophead flyplate. Also, these profiled sections have slots plugged with press-fit polymer caps on their sides which enables easy handling and prevents entry of foreign particles through the slots. Also, the profiled section has a provision at the top for a timber or polymer insert for nailing and a bottom groove to accommodate connections with other accessories of the system like t-bolts etc. The secondary beam devoid of the end hooks also act as a normal formwork girder which can be used for various applications.

In another embodiment, a drophead adaptor and additional adapters which could be either out of steel or aluminium or polymer to avoid plywood trapping during the early striking of the formwork is disclosed. In one example, a drophead adaptor is used in one of the early striking scenarios where the plywood trapping needs to be avoided. The other beam adapters can have two configurations. In one configuration, the adapter is formed as a hollow cuboid-shaped body with a rectangular cross-section. The adapter also includes flanges on either side. Further, each flange is configured to receive a sheathing member on which the concrete is poured. Further, the flanges are designed in such a way that a top surface of the sheathing member, a top side of the adapter, and the top surface of the drophead unit along with the drophead adaptor are coplanar when the sheathing member when coupled to or supported on the flange. Further, the drophead adaptor fixed to the drophead with prop will remain till the removal of the props while the secondary beam adaptors fixed to secondary beams can be removed during de-shuttering. Moreover, the beam adaptors can be fixed to assemblies of drophead unit & secondary beams respectively on the ground itself and can be swung from below during erection of the system. In another configuration, a closure beam is disclosed which will sit on top of a primary beam in the joint between two sheathing members after the erection of the formwork. The top of the closure beam is at the same level of the top of the sheathing member. The ends of the closure beam will sit on the top of the drophead and will remain fixed to the slab soffit till the removal of the props while the rest of the formwork can be removed.

Overall, according to the present disclosure, the system with a multi-level drophead allows the construction of both the standard and cantilever grids using the same components that otherwise would require a separate set of cantilever elements along with some attachments to dropheads or any other means, thereby reducing the overall cost associated with formwork. On the other hand, the adapters allow to dismantle the primary & secondary beams along with plywood and avoid plywood trapping during early striking while the props remain in position as back propping. This ensures the cycle time and productivity as the same elements can be used for the next slab pour.

To further clarify the advantages and features of the present invention, a more particular description of the invention will be rendered by reference to specific embodiments thereof, which is illustrated in the appended drawings. It is appreciated that these drawings depict only typical embodiments of the invention and are therefore not to be considered limiting of its scope. The invention will be described and explained with additional specificity and detail with the accompanying drawings.

BRIEF DESCRIPTION OF THE DRAWINGS

These and other features, aspects, and advantages of the present invention will become better understood when the following detailed description is read with reference to the accompanying drawings in which like characters represent like parts throughout the drawings, wherein.

Figure 1A:
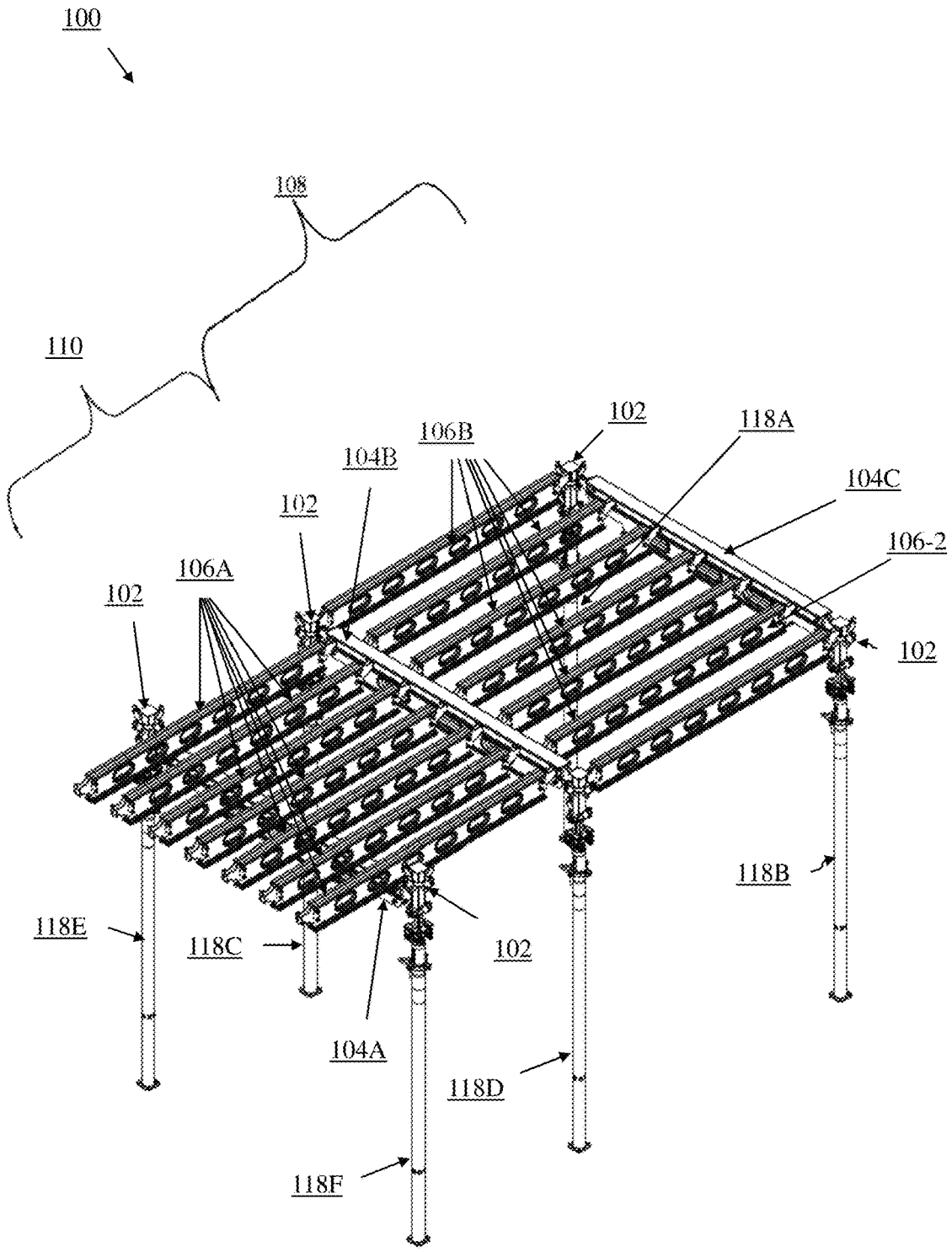
FIG. 1A shows a perspective view of a formwork in a normal scenario with early striking, according to an embodiment of the present disclosure.

Further, skilled artisans will appreciate that elements in the drawings are illustrated for simplicity and may not have necessarily been drawn to scale. For example, the flow charts illustrate the method in terms of the most prominent steps involved to help to improve understanding of aspects of the present invention. Furthermore, in terms of the construction of the device, one or more components of the device may have been represented in the drawings by conventional symbols, and the drawings may show only those specific details that are pertinent to understanding the embodiments of the present invention so as not to obscure the drawings with details that will be readily apparent to those of ordinary skill in the art having benefit of the description herein.

DETAILED DESCRIPTION OF FIGURES

For the purpose of promoting and understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated system, and such further applications of the principles of the invention as illustrated therein being contemplated as would normally occur to one skilled in the art to which the invention relates. Unless otherwise defined, all technical and scientific terms used herein have the same meaning as commonly understood by one of ordinary skilled in the art to which this invention belongs. The system, methods, and examples provided herein are illustrative only and not intended to be limiting.

For example, the term "some" as used herein may be understood as "none" or "one" or "more than one" or "all." Therefore, the terms "none," "one," "more than one," "more than one, but not all" or "all" would fall under the definition of "some." It should be appreciated by a person skilled in the art that the terminology and structure employed herein is for describing, teaching, and illuminating some embodiments and their specific features and elements and therefore, should not be construed to limit, restrict or reduce the spirit and scope of the present disclosure in any way.

For example, any terms used herein such as, "includes," "comprises," "has," "consists," and similar grammatical variants do not specify an exact limitation or restriction, and certainly do not exclude the possible addition of one or more features or elements, unless otherwise stated. Further, such terms must not be taken to exclude the possible removal of one or more of the listed features and elements, unless otherwise stated, for example, by using the limiting language including, but not limited to, "must comprise" or "needs to include."

Whether or not a certain feature or element was limited to being used only once, it may still be referred to as "one or more features" or "one or more elements" or "at least one feature" or "at least one element." Furthermore, the use of the terms "one or more" or "at least one" feature or element do not preclude there being none of that feature or element, unless otherwise specified by limiting language including, but not limited to, "there needs to be one or more . . . " or "one or more element is required."

Unless otherwise defined, all terms and especially any technical and/or scientific terms, used herein may be taken to have the same meaning as commonly understood by a person ordinarily skilled in the art.

Reference is made herein to some "embodiments." It should be understood that an embodiment is an example of a possible implementation of any features and/or elements of the present disclosure. Some embodiments have been described for the purpose of explaining one or more of the potential ways in which the specific features and/or elements of the proposed disclosure fulfil the requirements of uniqueness, utility, and non-obviousness.

Use of the phrases and/or terms including, but not limited to, "a first embodiment," "a further embodiment," "an alternate embodiment," "one embodiment," "an embodiment," "multiple embodiments," "some embodiments," "other embodiments," "further embodiment", "furthermore embodiment", "additional embodiment" or other variants thereof do not necessarily refer to the same embodiments. Unless otherwise specified, one or more particular features and/or elements described in connection with one or more embodiments may be found in one embodiment, or may be found in more than one embodiment, or may be found in all embodiments, or may be found in no embodiments. Although one or more features and/or elements may be described herein in the context of only a single embodiment, or in the context of more than one embodiment, or in the context of all embodiments, the features and/or elements may instead be provided separately or in any appropriate combination or not at all. Conversely, any features and/or elements described in the context of separate embodiments may alternatively be realized as existing together in the context of a single embodiment.

Any particular and all details set forth herein are used in the context of some embodiments and therefore should not necessarily be taken as limiting factors to the proposed disclosure.

Embodiments of the present invention will be described below in detail with reference to the accompanying drawings.

Figure 1B:
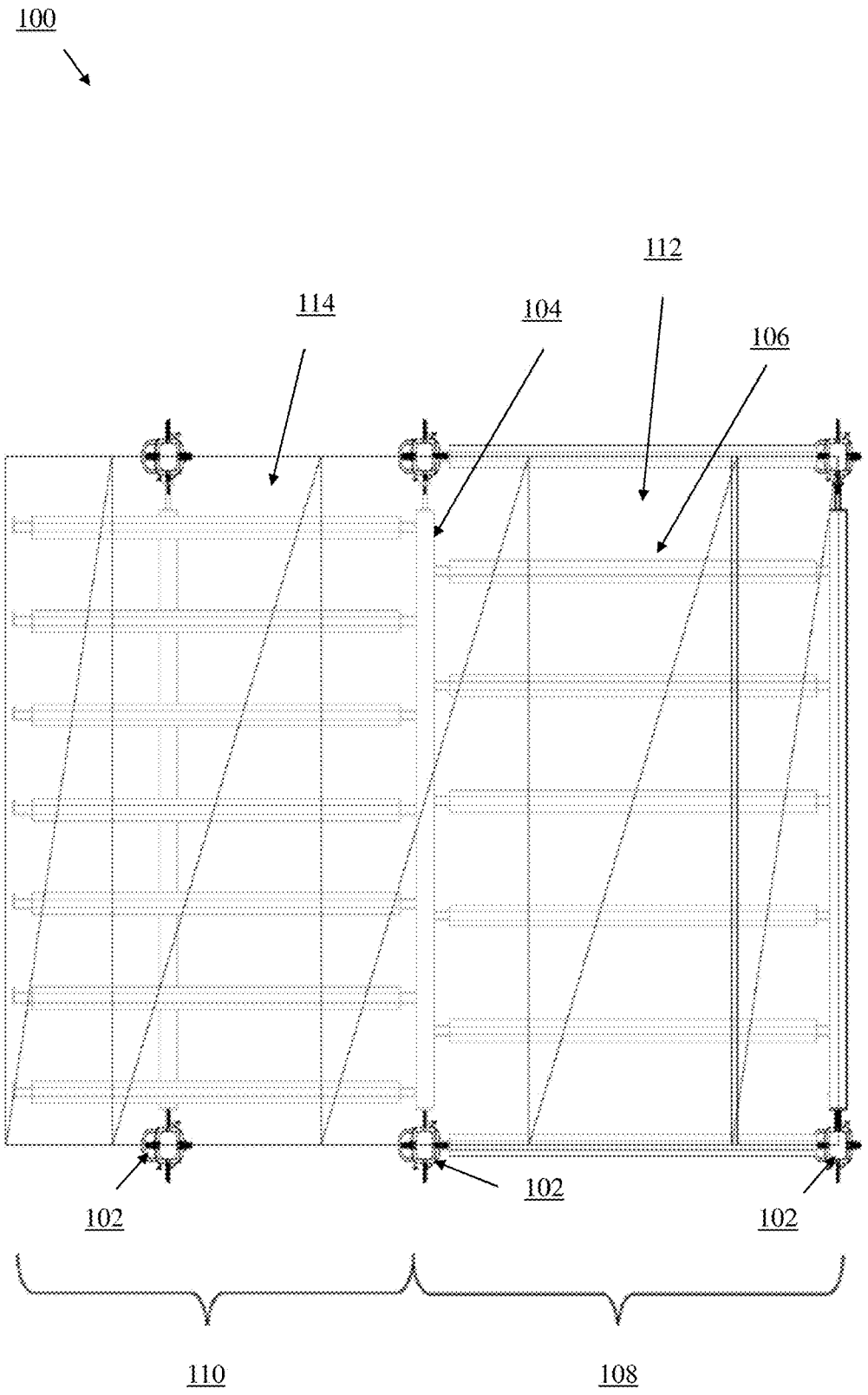
FIG. 1B illustrates a plan view of the formwork in the normal scenario with early striking, according to an embodiment of the present disclosure.

FIGS. 1A and 1B illustrate different views and details of a first formwork 100 and a multi-level drophead unit 102, according to an embodiment of the present disclosure. Specifically, FIG. 1A shows a perspective view of the first formwork 100 in a normal scenario with early striking while FIG. 1B shows a plan view of the first formwork 100 of FIG. 1A. The first formwork 100 may include, but is not limited to, a plurality of primary beams 104 and secondary beams 106, a plurality of props 118, and a plurality of multi-level drophead unit 102.

The first formwork 100 may include a plurality of posts or props 118A, 118B, 118C, 118D, 118E, 118F, commonly referred as 118, and a plurality of multi-level drophead units 102 that may be configured to provide support to the primary beam 104 and the secondary beam 106. The prop 118 may be made of a material that has the requisite strength to support the grid, the poured concrete and the load of the operator(s). As may be understood, the multi-level drophead unit 102 may also be configured to support the load of the grid, the poured concrete and the load of the operator(s). The multi-level drophead unit 102 can have different designs. Details of the different multi-level drophead unit 102 may be explained in conjunction with FIGS. 3A, 3C, and 3G.

The first formwork 100 may be formed as grids which is made of the plurality of primary beams 104 and secondary beams 106 shown in FIGS. 1A and 1B. These beams may be denoted as 104A, 104B & 104C and 106A to 106B to distinguish between various locations for which they have been used. Further, the grid may include a first or standard grid 108 and a second or cantilever grid 110 as shown in FIGS. 1A and 1B. The first or standard grid 108 may be used as a platform to build a structure in the interior of a building and may include a first sheathing member 112 and the second or cantilever grid 110 may be used to build a structure at the periphery or inside of a building including using it as a platform for concreting or any other purposes like a working platform for workmen. The standard grid 108 may include a first sheathing member 112. In one example, the sheathing member 112 can be made of plywood. As shown clearly in FIG. 1A, the primary beams 104 may be supported on the multi-level drophead unit 102 which are in turn fixed to props 118 and may be configured to support the plurality of secondary beams 106 thereon to form the grid.

Further, the cantilever grid 110 may also be formed by combining the primary beams 104 and the secondary beams 106 and may include a second sheathing member 114. Further, the primary beams 104 and the secondary beams 106 of the cantilever grid 110 are arranged in such a way that the second sheathing member 114 is flush with the first sheathing member 112 and a flat horizontal surface is achieved. The cantilever grid 110 may be called so because one end of each secondary beam 106A is attached to the side of the primary beam 104B while another end not attached to the primary beam 104A thereby forming a cantilever grid. Instead, the secondary beam 106A rests on top of the primary beam 104A resulting in the overhang of the other end of the secondary beam 106A on the primary beam 104A.

In one example, the primary beam 104 and the secondary beam 106 are made as single metal piece formed by extrusion process. Further, the primary beam 104 and the secondary beam 106 can be made using Aluminium. Specifically, the primary beam 104 is disclosed which could be made out of a single aluminium extruded profile. This could also be made of two independent sections connected back-to-back. Moreover, the primary beam could also be formed out of, steel or any other metal, polymer or a composite material or timber girders by replacing the aluminium extruded profile to any customised length as required.

According to the present disclosure, the primary beam 104 can have various design. For instance, the primary beam 104 may have a profile with cavity along the sides and a single hook shaped connecting member. Such an example is shown in FIG. 2A.

Figure 2A:
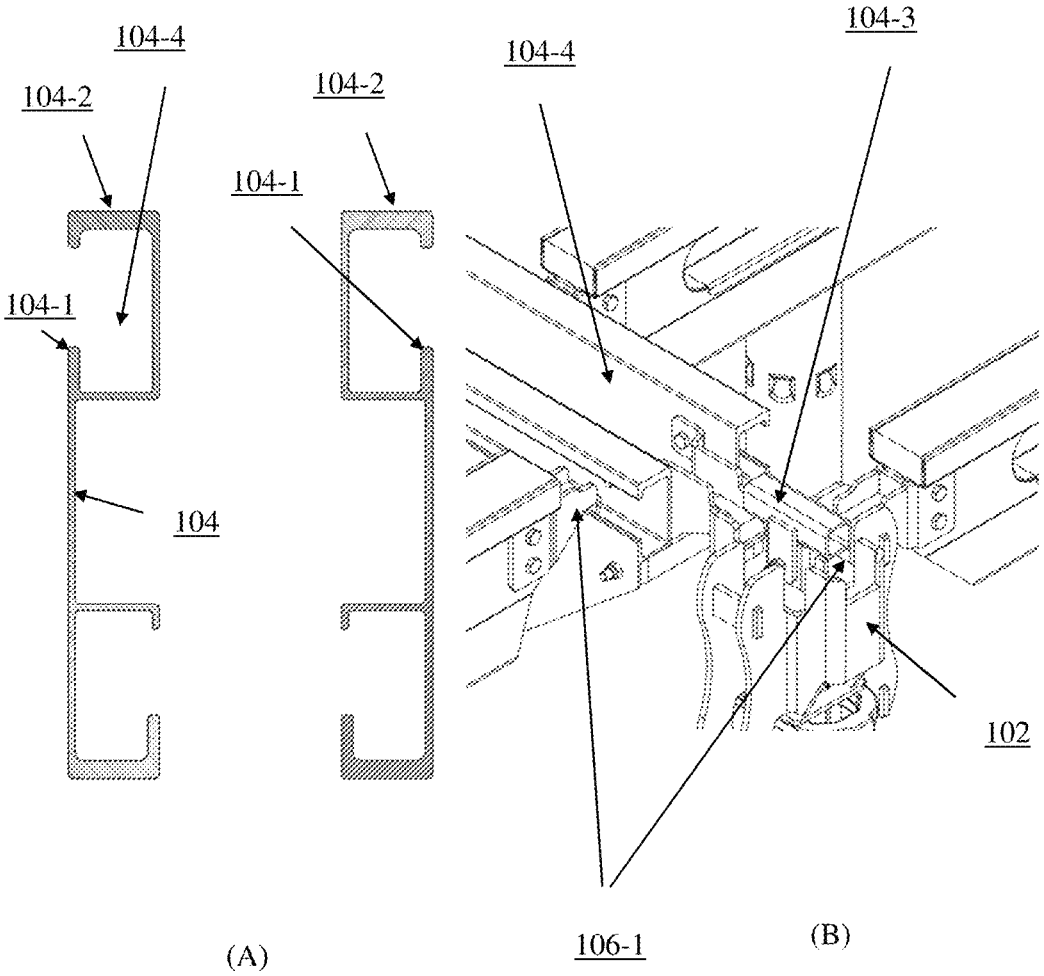
FIG. 2A illustrates a cut section of a primary beam and mounting of the primary beam to a multi-level drophead adapter, according to an embodiment of the present disclosure.

Referring now to (A) in FIG. 2A, each of the primary beam 104 includes a pair of lips 104-1 to receive a connecting member 106-1 on the ends of the secondary beam 106 as shown in view (B) in FIG. 2A, such that the connecting member 106-1 may rest on the lips 104-1 or on the multi-level drophead unit 102. The primary beam 104 too may have a connecting member 104-3, in a different design and configuration, adapted to couple to the multi-level drophead unit 102 as shown in (B) of FIG. 2A. The primary beam 104 may also include a top surface 104-2 that has a cavity 104-4, and a first side and a second side both adjacent to the top surface 104-2, and each having the lips 104-1. The secondary beam 106 may be secured to the primary beam 104 or to the drophead unit 102, such that the secondary beams 106 can be decoupled from the primary beam 104 or multi-level drophead unit 102 during the striking process. The striking process may be understood as a process of removing the sheathing member, the primary beam 104 and the secondary beam 106 after the concrete has cured to achieve required compressive strength to carry its own self-weight.

While the primary beam in FIG. 2A has a short and slim profile and has a slot shaped connecting member 104-3, the primary beam 104 may have a double hook design. Such an exemplary primary beam 104 is shown in FIG. 2B.

Figure 2B:
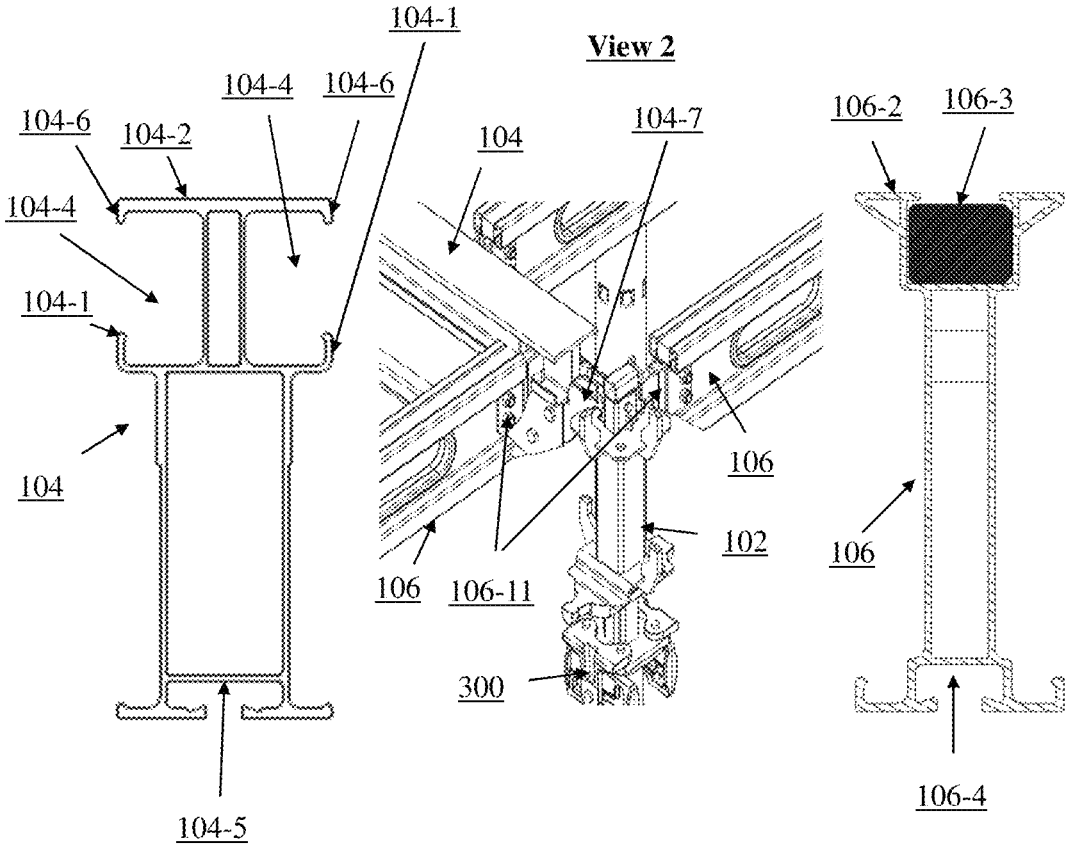
FIG. 2B illustrates a cut section of another primary beam with double walled end hook, mounting of the primary beam to a multi-level drophead adapter, and a cut section of a secondary beam, according to an embodiment of the present disclosure.

Referring now to (A) of FIG. 2B, each of the primary beam 104 includes a pair of top downward lips 104-6 and a pair of bottom upward lips 104-1 forming cavities 104-4 on either side to receive a self-rotational locking hook 106-11 fixed to the ends of the secondary beam 106 as shown in (B) in FIG. 2B. The self-rotational locking hook 106-11 of secondary beam 106 may rest on the lips 104-1 before getting locked into the cavity 104-4 or to the multi-level drophead unit 102. The primary beam 104 may also include a double walled hook 104-7 that latches to the drophead unit 102.

The primary beam 104 may also include a top surface with downward lips 104-6 on a first side and a second side both adjacent to the top surface, and also each having the bottom upward lips 104-1. The primary beam 104 also include a latching cavity 104-4 formed between the bottom upward lips 104-1 and the top surface with downward lips 104-6. The latching cavity 104-4 is configured to lock the self-rotational locking hook 106-11 and prevent inadvertent dislodgement of the self-rotational locking hook 106-11 from the latching cavity 104-4 of primary beam 104. Furthermore, the primary beam 104 may include a bottom groove 104-5 to accommodate bolts, T-bolts or any other component. Thus, the primary beam 104 can store the fastener which does away a need of a separate arrangement to carry such fasteners.

Figure 2C:
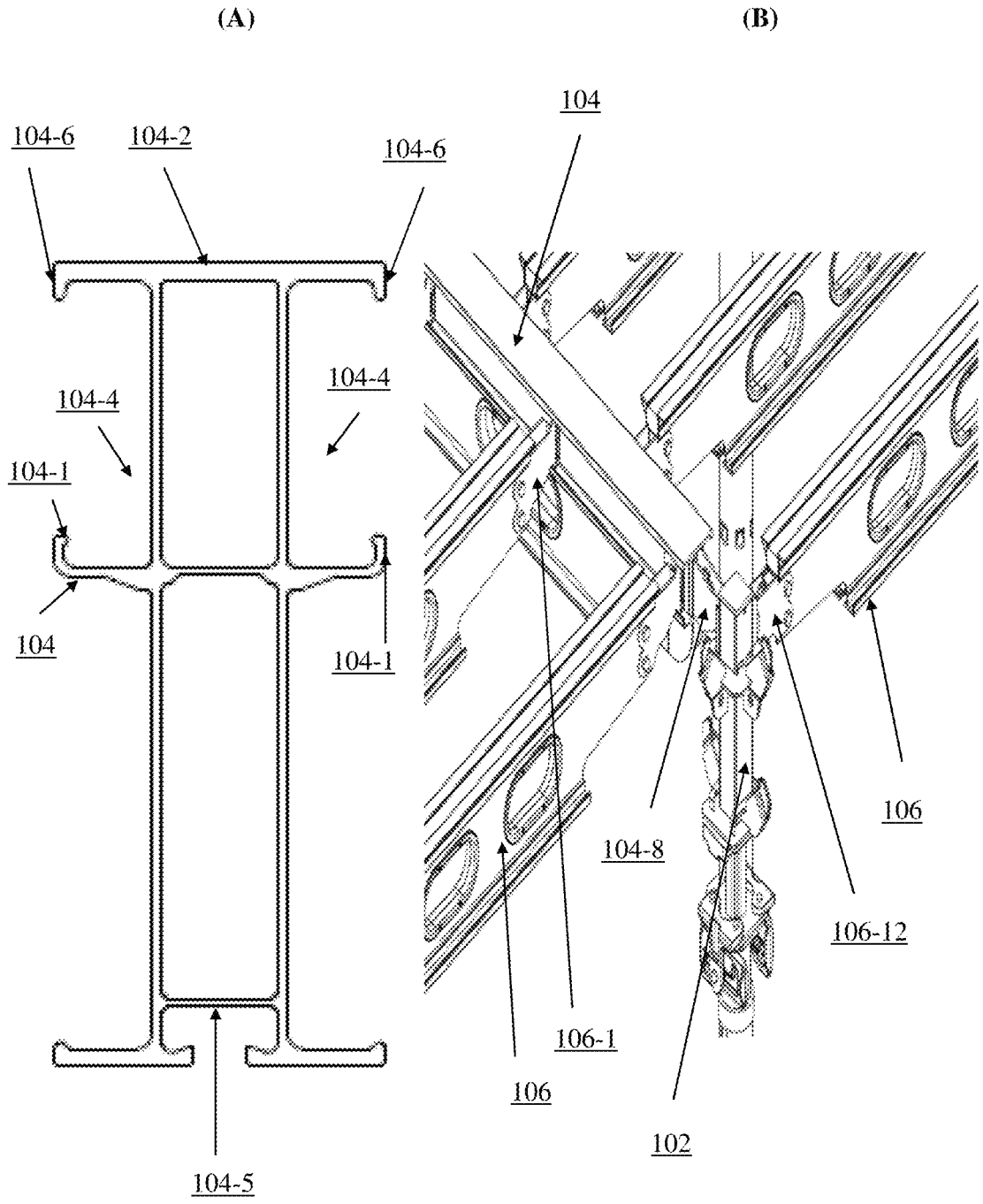
FIG. 2C illustrates a cut section of yet another primary beam with double walled end hook, mounting of the primary beam to a multi-level drophead adapter, and a cut section of another secondary beam, according to an embodiment of the present disclosure.

Yet another type of primary beam 104 is explained with respect to FIG. 2C. Further, each primary beam 104 may include a double-walled end-hook 104-3 and each secondary beam 106 may also include a specially designed double-walled end hook 106-12 whose details will be provided later with respect to FIGS. 2C and 2D.

Referring now to (A) in FIG. 2C, each of the primary beam 104 includes a pair of top downward lips 104-6 and a pair of bottom upward lips 104-1 forming cavities 104-4 on either side to receive a specially designed double-walled end hook 106-12 fixed to the ends of the secondary beam 106 as shown in view 1 or another primary beam 104 in FIG. 1B.

The specially designed double-walled end hook 106-12 of secondary beam 106 may rest on the lips 104-1 before getting locked into the cavity 104-4 or to any the attachment portions of the multi-level drophead unit 102. The primary beam 104 also include a cavity 104-4 formed between the bottom upward lips 104-1 and the top surface with downward lips 104-6. The cavity 104-4 is configured to lock the secondary beam 106 with the help of its specially designed double-walled end hook 106-12 which makes the beam self-rotational and prevents inadvertent dislodgement of the beam from the cavity 104-4 of primary beam 104. The secondary beam 106 can be installed manually. The secondary beam 106 may be secured to the primary beam 104 or to the multi-level drophead unit 102, such that the secondary beams 106 can be decoupled from the primary beam 104 or multi-level drophead unit 102 during the striking process. The striking process may be understood as a process of removing the sheathing member, the primary beam 104 and the secondary beam 106 after the concrete has cured to achieve required compressive strength to carry its own self-weight.

Figure 2D:
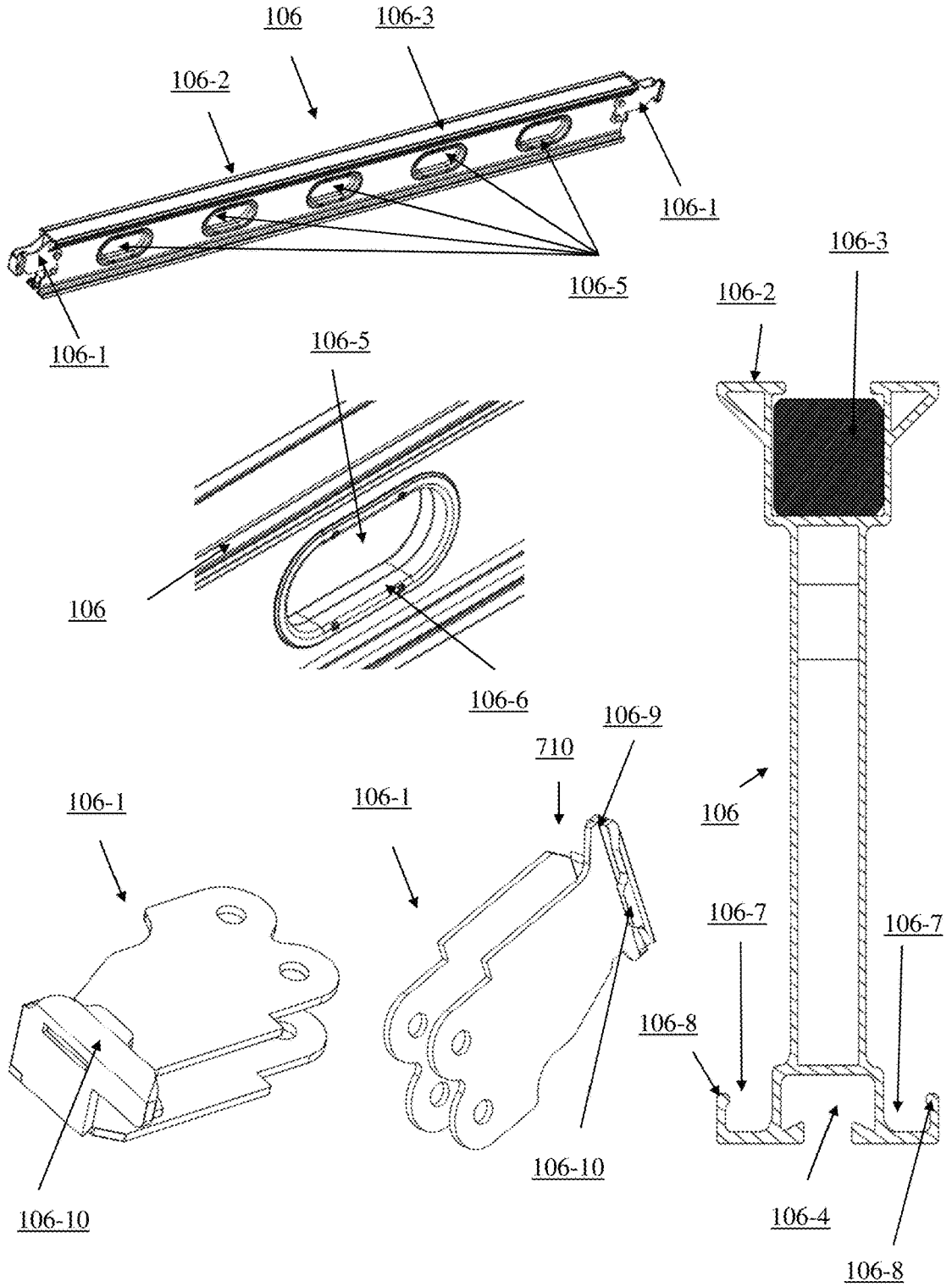
FIG. 2D illustrates a secondary beam, according to an embodiment of the present disclosure.

Referring now to (B) in FIG. 2C and FIG. 2D, the secondary beam 106 may be formed as a single piece extruded component made from Aluminium. The secondary beam 106 includes a self-rotational hook 106-1 having a face 106-9. In one example, a face 106-9 of the end hook 106-1 of the secondary beam 106 locks with the upper surface of the cavity 104-4 of the primary beam 104. In addition, the secondary beam 106 has a hook 106-10 adjacent to the rotational lock 106-1 and adapted to engage to the lip 104-1 of the cavity 104-4 of the primary beam 104.

Further, the secondary beam 106 includes a body that may be an aluminium extruded profile with top flanges 106-2 on either side of a nailing insert 106-3 located centrally to receive a sheathing member 112 as shown in view 3-3 of FIG. 2D. The secondary beam 106 also includes a bottom groove 106-4 which allows for the fixing of any add-on accessories like t-bolts etc. The secondary beam 106 also includes slots 106-5 fitted with polymer caps 106-6 over the slots as shown in FIG. 1D. In addition, the secondary beam 106 has a cavity 106-7 formed by lips 106-8. The cavity 106-7 has a structure similar to the cavity 104-4 and is configured to attach the cross truss, or horizontal truss or any other elements. As a result, the cavity 106-7 enables an operator to mount other elements to the secondary beam 106 without the use of additional or dedicated equipment or mounts.

As mentioned before, the primary beams 104 and the secondary beam 106 are connected to the multi-level drophead unit 102 to form the grid. In other words, the multi-level drophead unit 102 may act as a juncture to which a set of the primary beams 104 and secondary beams 106 can connect. The multi-level drophead unit 102 can have different designs based on the type of the primary beam 104 and the secondary beam 106. Exemplary multi-level drophead unit 102 are illustrated with respect to the FIGS. 3A to 3K.

Figure 3A:
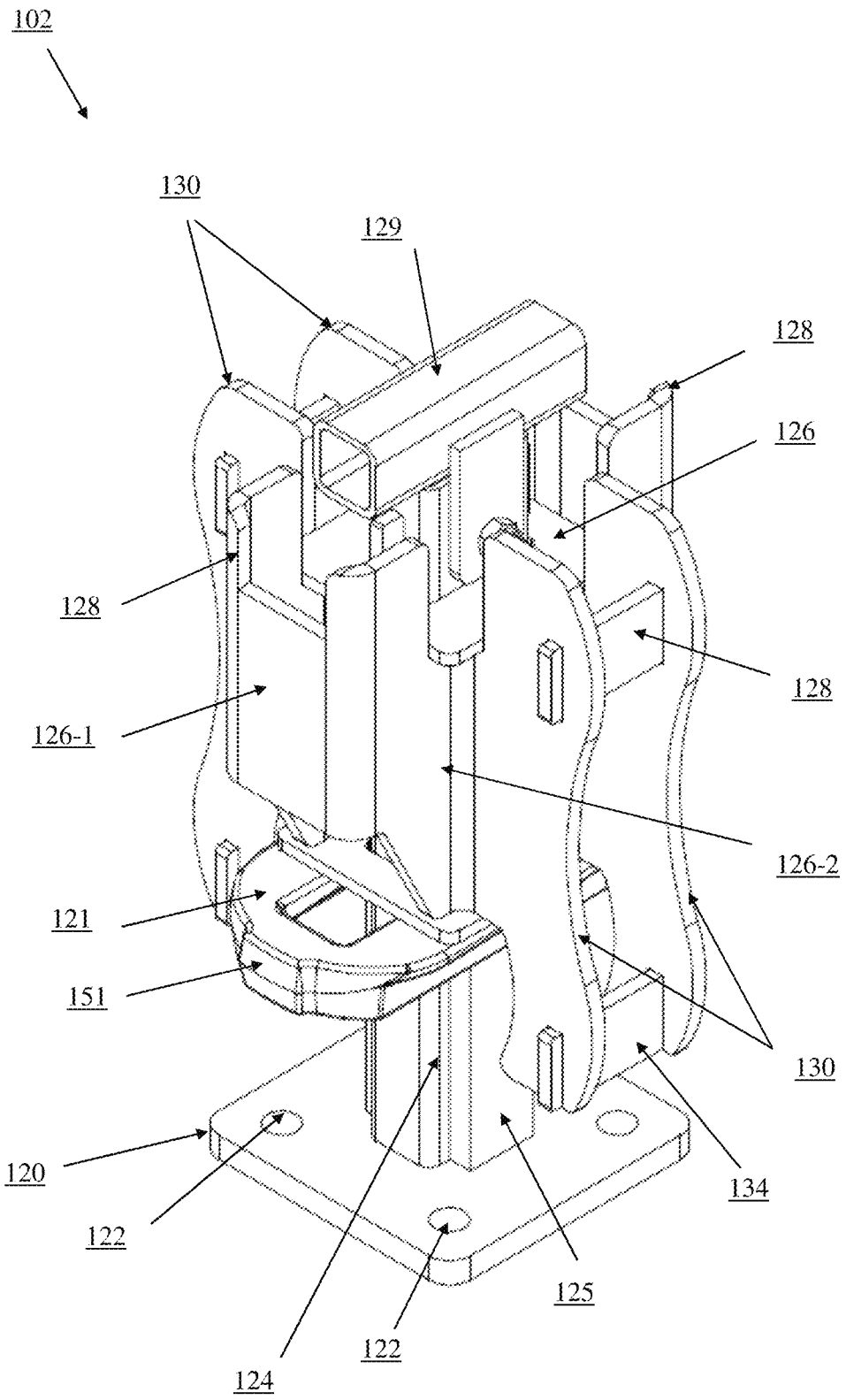
FIG. 3A illustrates a multi-level drophead unit that couples to the primary beam of FIG. 2A, according to an embodiment of the present disclosure.

FIG. 3A illustrates a multi-level drophead unit 102 that couples to the primary beam of FIG. 2A, according to an embodiment of the present disclosure. The multi-level drophead unit 102 may include a base plate 120 that may couple of the multi-level drophead unit 102 to the post or prop 118. In one example, the base plate 120 may include a plurality of holes 122 to receive fastening members to couple the multi-level drophead unit 102 to the post or prop 118. Another way to couple the multi-level drophead unit 102 to the prop 118 is by using a quick fix clamp 1100, details of which will be discussed later.

The multi-level drophead unit 102 may also include a stem 124 attached to the base plate 120, such that the stem 124 is orthogonal to the base plate 120. The stem 124 may be configured to support the other parts of the multi-level drophead unit 102 thereon. In one example, the multi-level drophead unit 102 may also include a flyplate 126 that may be attached to a length of the stem 124. For instance, the flyplate 126 may be attached to a middle section of the stem 124, such that the stem 124 protrude from the flyplate 126. The flyplate 126 may slide along the stem 124.

The flyplate 126 may have a rectangular or square-shaped hollow cross-section and may include a first wall 126-1, a second wall 126-2, a third wall (not visible), and a fourth wall (not visible). The flyplate 126 may include a pair of first attachment portions 128 on the first wall 126-1 and the third wall. The first attachment portions 128 includes a cut-portion of a pre-defined shape to receive and secure a connecting member 106-1 (shown in FIG. 2A) of the secondary beam 106 or a connecting member 104-3 of the primary beam 104 thereon. As clearly shown, the first attachment portions 128 are formed on the periphery of the flyplate 126.

The flyplate 126 may also include a pair of flanges 130 attached to the second wall 126-2 and the fourth wall (not visible). The pair of flanges 130 may protrude from their respective walls. Further, each flange 130 may include a second attachment portion 128 and a third attachment portion 134 which are vertically spaced apart at a defined distance. In one example, the spacing between the two levels may be equal to the depth of the secondary beam 106. The second attachment portion 128 and the third attachment portion 134 are also configured to receive and secure the connecting member 104-3 at the two different levels as required in the standard or cantilever grids. Also, the attachment portions are designed in such a way that it will avoid the tilting of primary beam 104 during erection. Further, the second attachment portion 128 & the third attachment portion 134 can also receive the connecting member 106-1 of a secondary beam 106.

In one example, the first attachment portion 128, the second attachment portion 128, and the third attachment portion 134 enable the multi-level drophead unit 102 to have six attachments point over four attachments point in the currently known multi-level drophead units, thereby enabling versatility of the multi-level drophead unit 102 for making the first formwork 100. Specifically, the pair of first attachment portion 128 and the pair of the second attachment portion 128 provides four attachments points at a first level or top level while the pair of third attachments portion 134 provide two attachments points at a second level or bottom level different from the first level or the top level. In one example, the first level and the second level could be vertically spaced apart at a defined distance, that can also be equal to the depth of the secondary beam 106.

Moreover, the second attachment portion 128 and the third attachment portion 134 enables the top of cantilever grid 110 to be at a same elevation with respect to the top of standard grid 108. The same elevation for the cantilever grid 110 is achieved by coupling the primary beam 104A to the third attachment portion of the multi-level drophead unit 102 as shown in FIG. 1A and placing the secondary beams 106A on top of the primary beam 104A. Further, another end of the secondary beam 106A that includes the connecting member 106-1 can be coupled to the lips 104-1 of the primary beam 104B. The multi-level drophead unit 102 thus allows the same primary beams 104 and secondary beams 106 to be used to build the second grid 110 without the use of special equipment that are otherwise needed in currently known formworks. Moreover, the multi-level drophead unit 102 for the standard grid 108 to support the cantilever grid 110 eliminates a need for additional multi-level drophead units 102 or any drophead attachments and beams to construct the second grid 110.

Although one of the foregoing embodiments shows a top tube 129 of the multi-level drophead unit 102 as in FIG. 3A, other designs may be envisioned. An exemplary embodiment of a different drophead is shown in subsequent embodiments.

Figure 3B:
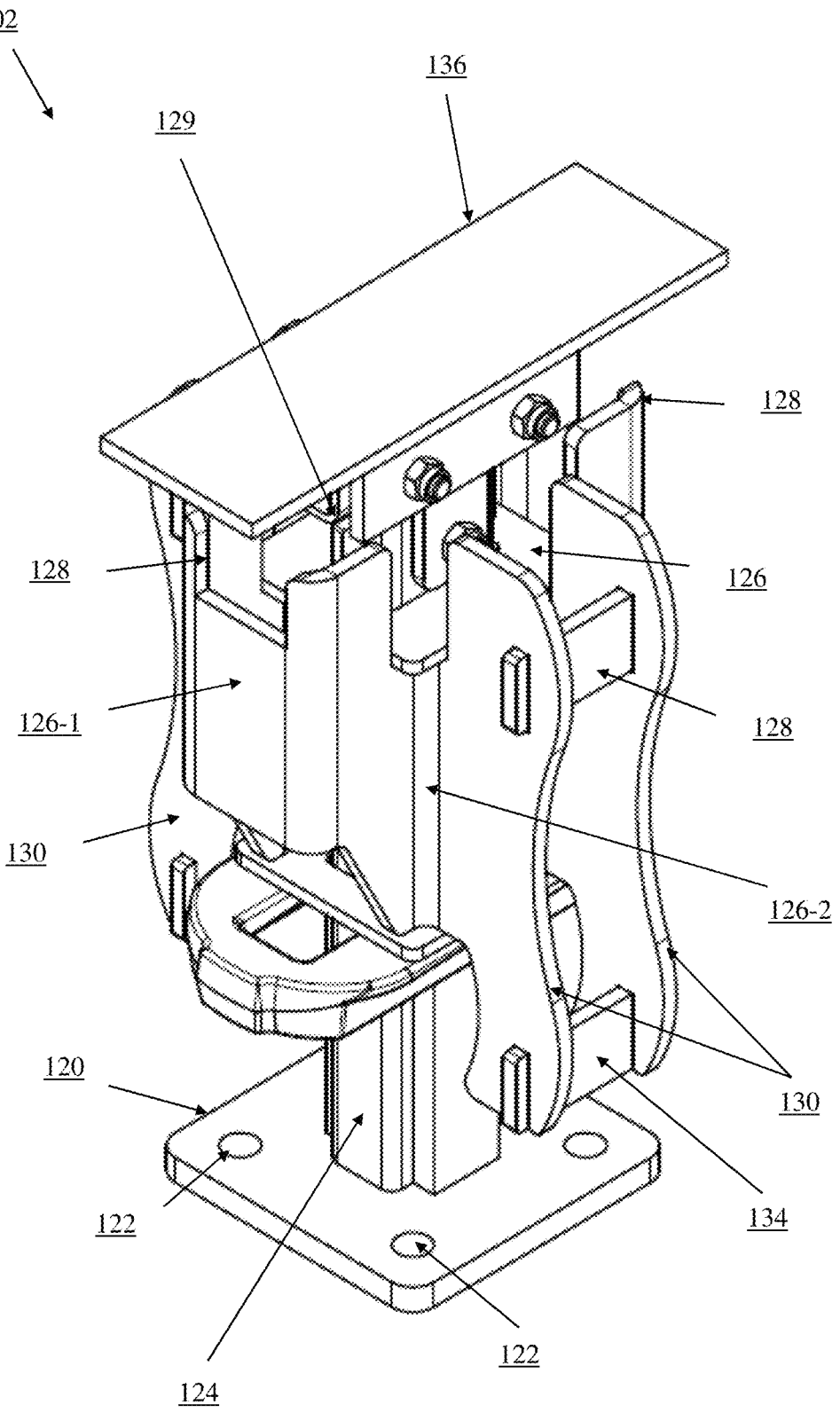
FIG. 3B illustrates the multi-level drophead unit of FIG. 3A with a drophead adaptor, according to an embodiment of the present disclosure.

Referring now to FIG. 3B, the multi-level drophead unit 102 may include a drophead adaptor 136 that may be attached to top tube 129 at an end of the stem 124 opposite to the end of the stem 124 attached to the base plate 120. The drophead adaptor 136 may be configured to be in flush with the first sheathing member 112. The drophead adaptor 136 is configured such that the drophead adaptor 136 is flush with a secondary beam adapter, or in other words, coplanar with secondary beam adapter. Such a placement allows for a flat surface for the first sheathing member 112 and consequently for the uncured concrete.

While the foregoing embodiment relates to a single plate-based attachment portions, the multi-level drophead unit 102 may have a hook design. Such an exemplary design is shown in FIG. 3C to FIG. 3F.

Figure 3C:
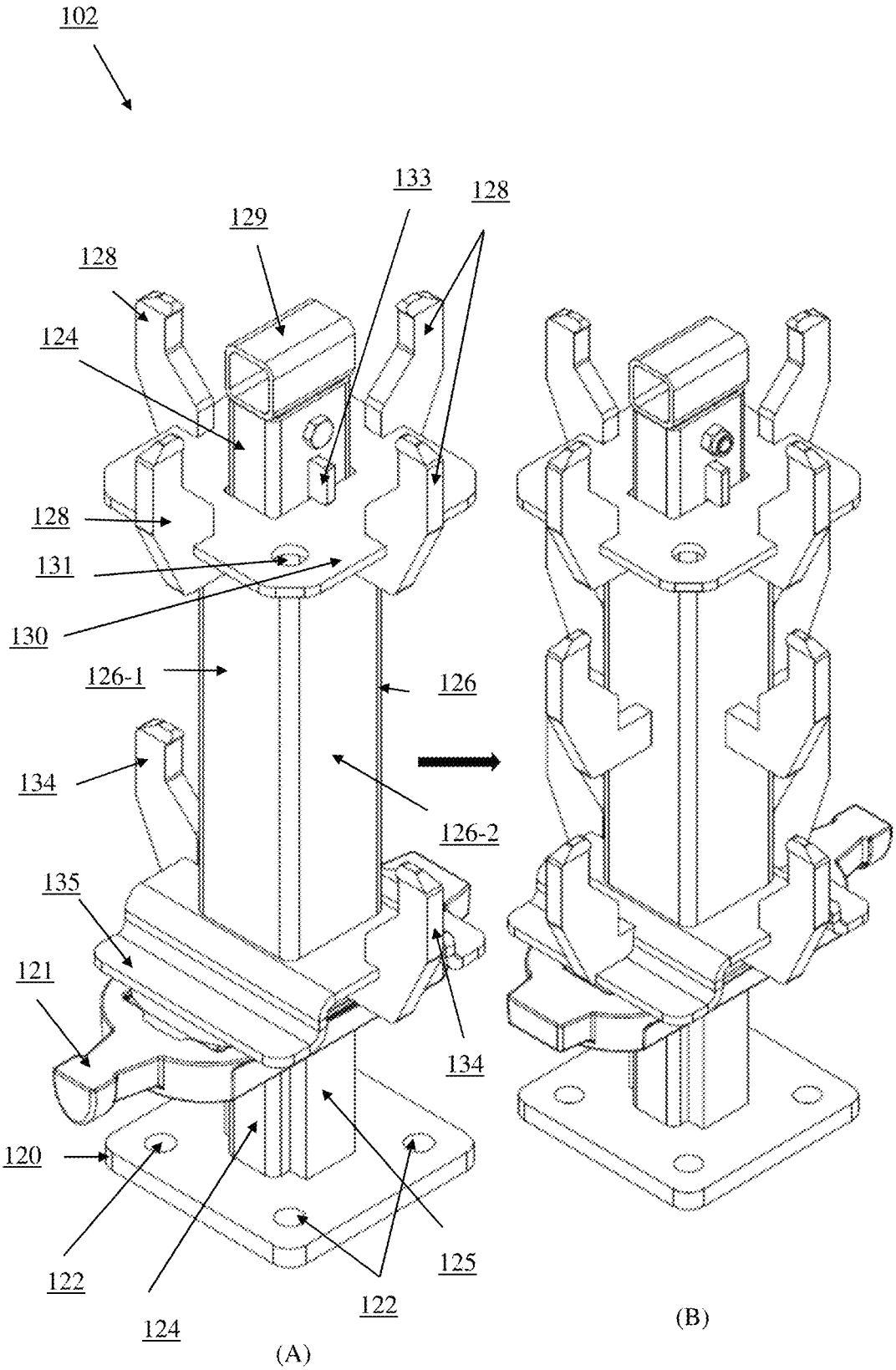
FIG. 3C illustrates a multi-level drophead unit with hooked attachment portions that couples to the primary beam of FIG. 2B, according to an embodiment of the present disclosure.
Figure 3D:
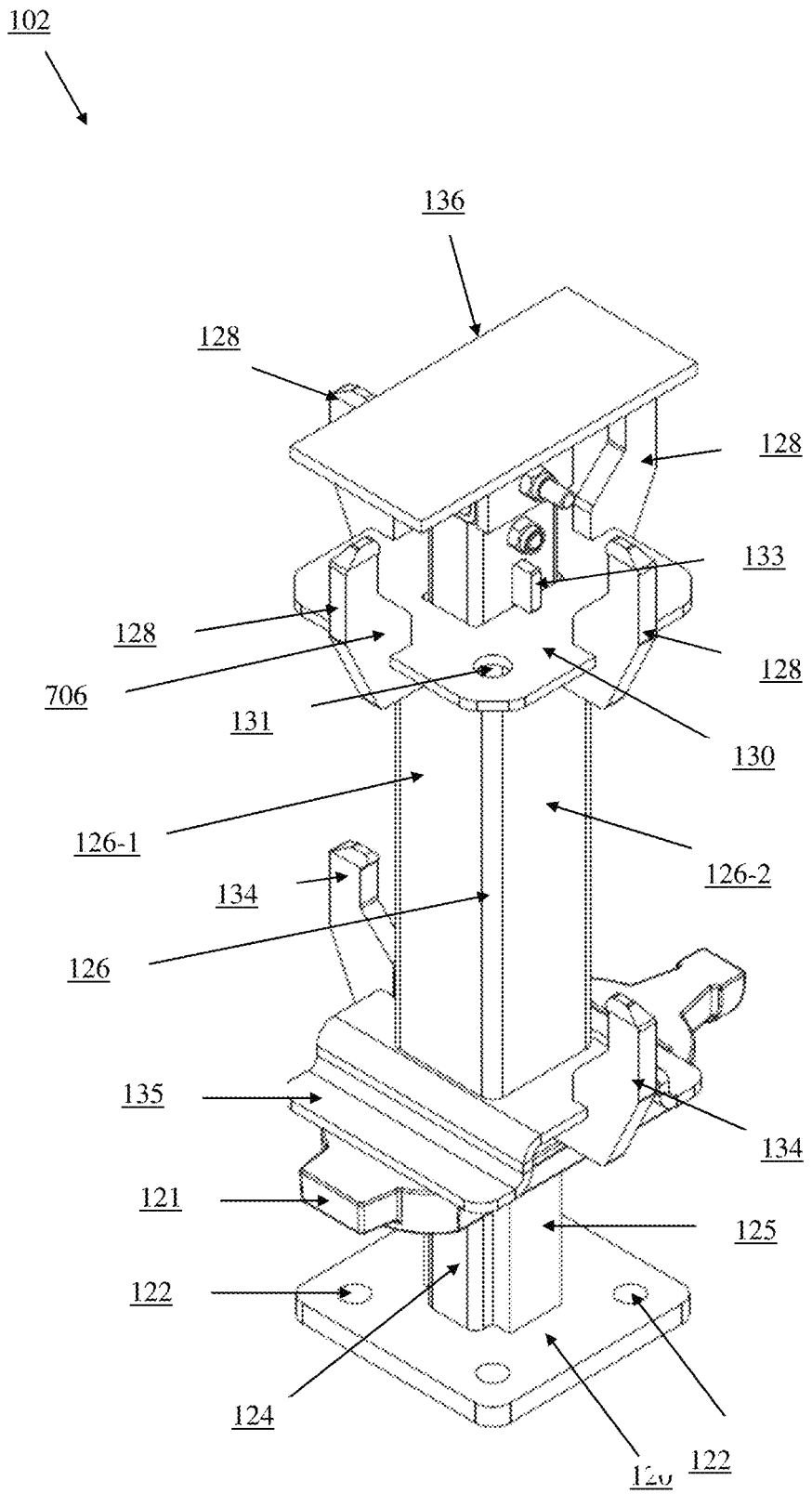
FIG. 3D illustrates a multi-level drophead unit of FIG. 3C with a drophead adaptor, according to an embodiment of the present disclosure.
Figure 3E:
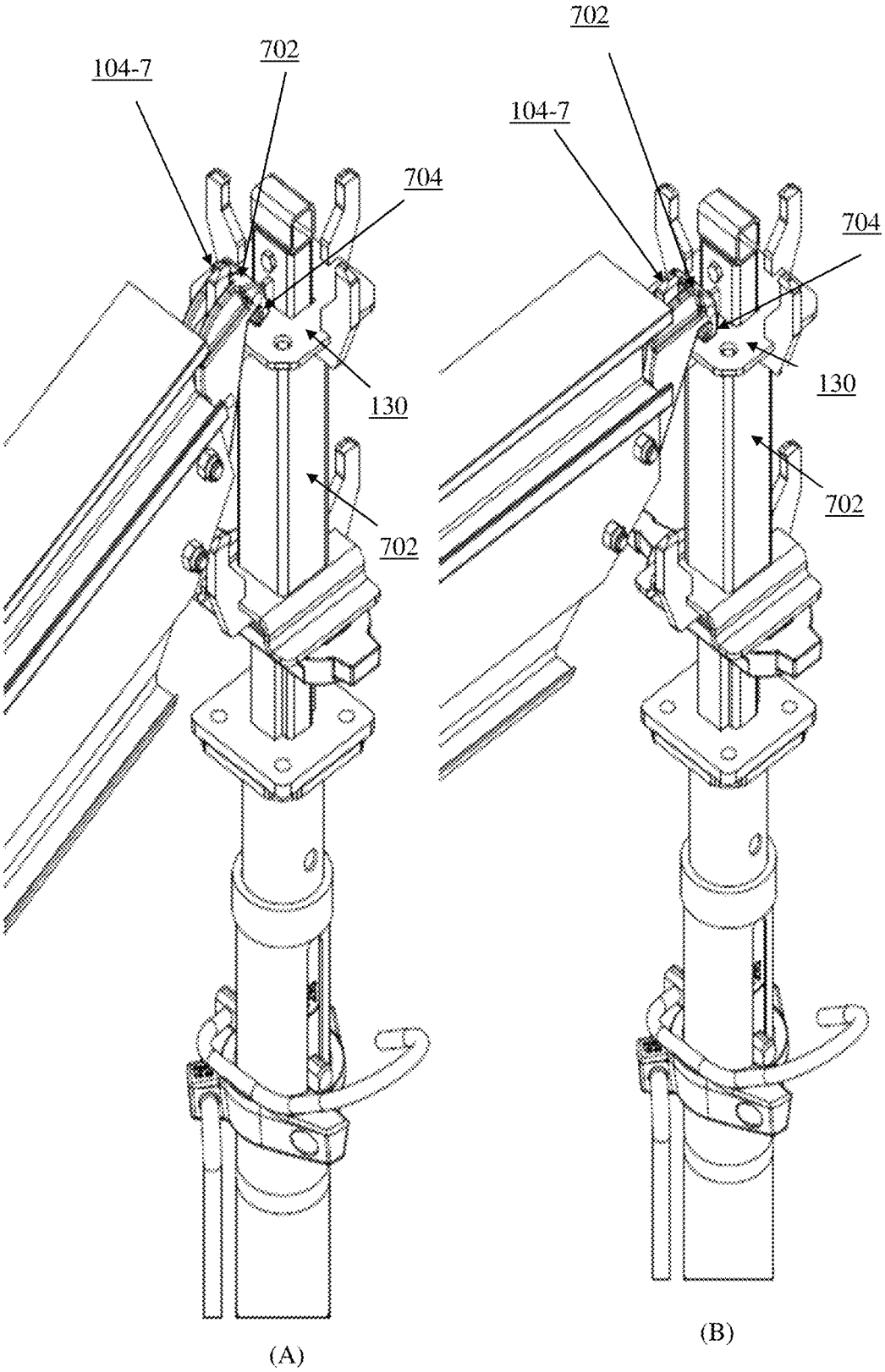
FIG. 3E illustrates a mounting of primary beam of FIG. 2B and the multi-level drophead unit of FIG. 3C, according to an embodiment of the present disclosure.
Figure 3F:
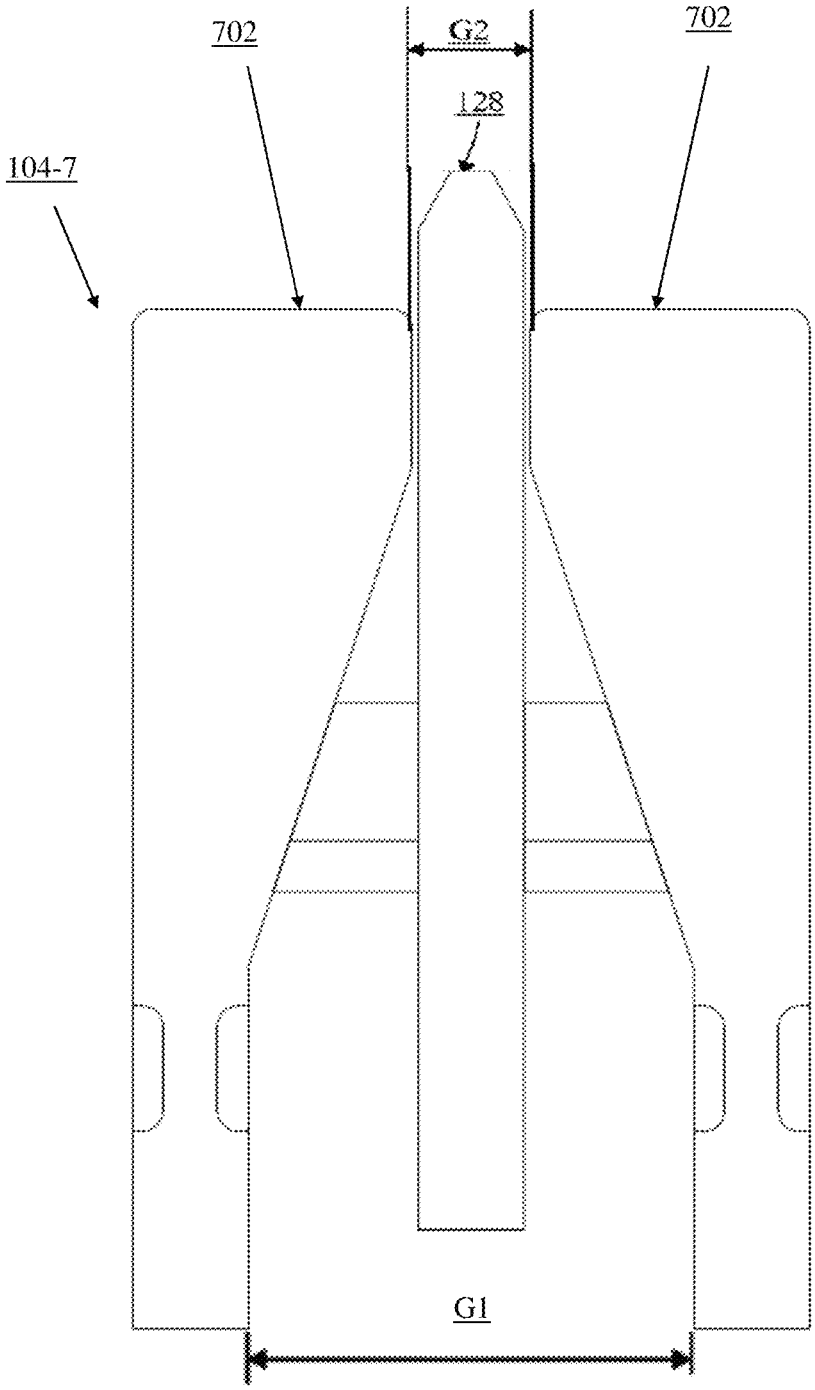
FIG. 3F illustrates a front view of a zoom in portion 'AA' showing the installation of the double horn of primary beam of FIG. 2B and the attachment portion of the multi-level drophead unit of FIG. 3C, according to an embodiment of the present disclosure.

Specifically, FIG. 3C illustrates a multi-level drophead unit with hooked attachment portions that couples to the primary beam of FIG. 2B while FIG. 3D illustrates a multi-level drophead unit 102 of FIG. 3C with a drophead adaptor. Further, FIG. 3E illustrates a mounting of the primary beam of FIG. 2B and the multi-level drophead unit of FIG. 3C while FIG. 3F illustrates a front view of a zoom in portion 'AA' showing the installation of the double walled hook of primary beam of FIG. 2B and the attachment portion of the multi-level drophead unit of FIG. 3C.

The multi-level drophead unit 102 includes a stem 124 attached to a base plate 120, such that the stem 124 is orthogonal to the base plate 120. The stem 124 may be configured to support the other parts of the multi-level drophead unit 102 thereon. In one example, the multi-level drophead unit 102 may also include a flyplate tube 126 that may be attached to a length of the stem 124. The flyplate tube 126 may slide along the stem 124 until the level of the stopper plate 133 and cannot move further up as the top plate 130 of flyplate tube 126 hits the stopper plate 133. The wedge 121 is over the loading plate 125 in the locked position while it slides down to the base plate 120 once it is hammered during striking process.

The flyplate tube 126 may have a rectangular or square-shaped hollow cross-section and may include a first wall 126-1, a second wall 126-2, a third wall (not visible), and a fourth wall (not visible). The flyplate tube 126 may include a top plate 130 that may include a pair of first hooks 128 on the side of first wall 126-1 and the third wall (not visible) parallel to the top tube 129. The first hooks 128 includes a cut-portion of a pre-defined shape to receive and secure a self-rotational locking hook 106-11 (shown in FIG. 2B) of the secondary beam 106 thereon.

The flyplate tube 126 may include a second pair of hooks 128 on the top plate 130 on the side of second wall 126-2 and the fourth wall (not visible) in a perpendicular direction to the top tube 129 and a third pair of hooks 134 on the bottom plate 135 of the flyplate tube 126 which are vertically spaced from the first pair of hooks 128 and second pair of hooks 128. In one example, the spacing between the two levels may be equal to the depth of the secondary beam 106. The second pair of hooks 128 and the third pair of hooks 134 are also configured to receive and secure the double-walled hook 104-7 at the two different levels as required in the standard or cantilever grids. Also, the hooks are designed in such a way that it will avoid the tilting of primary beam 104 during erection. During the assembly, the second pair of hooks 128 and the third pair of hooks 134 couples to the double-walled hook 104-7.

In one example, the first hook 128, the second hook 128, and the third hook 134 enable the multi-level drophead unit 102 to have six attachments point over four attachments point in the currently known drophead units, thereby enabling versatility of the multi-level drophead unit 102 for making the first formwork 100. Specifically, the pair of first hook 128 and the pair of the second hook 138 provides four attachments points at a first level or top level while the pair of third attachments portion 134 provide two attachments points at a second level or bottom level different from the first level or the top level. In one example, the first level and the second level could be spaced vertically apart from each other, that can be equal to the depth of the secondary beam 106. Although the present illustration shows the number of third hooks 134 as two, additional number/pair of fifth attachment points and sixth attachment portions or hooks may also be used that are formed on a third level, such that the third level is above the second level but below the first level. Additional attachment portions increase the total count of coupling to eight or even twelve by adding another layer of hooks in-between as shown in (B) in FIG. 3C. Additional or lesser number of hooks at level or at any direction can be envisioned without departing from the scope of the present disclosure.

Figure 8A:
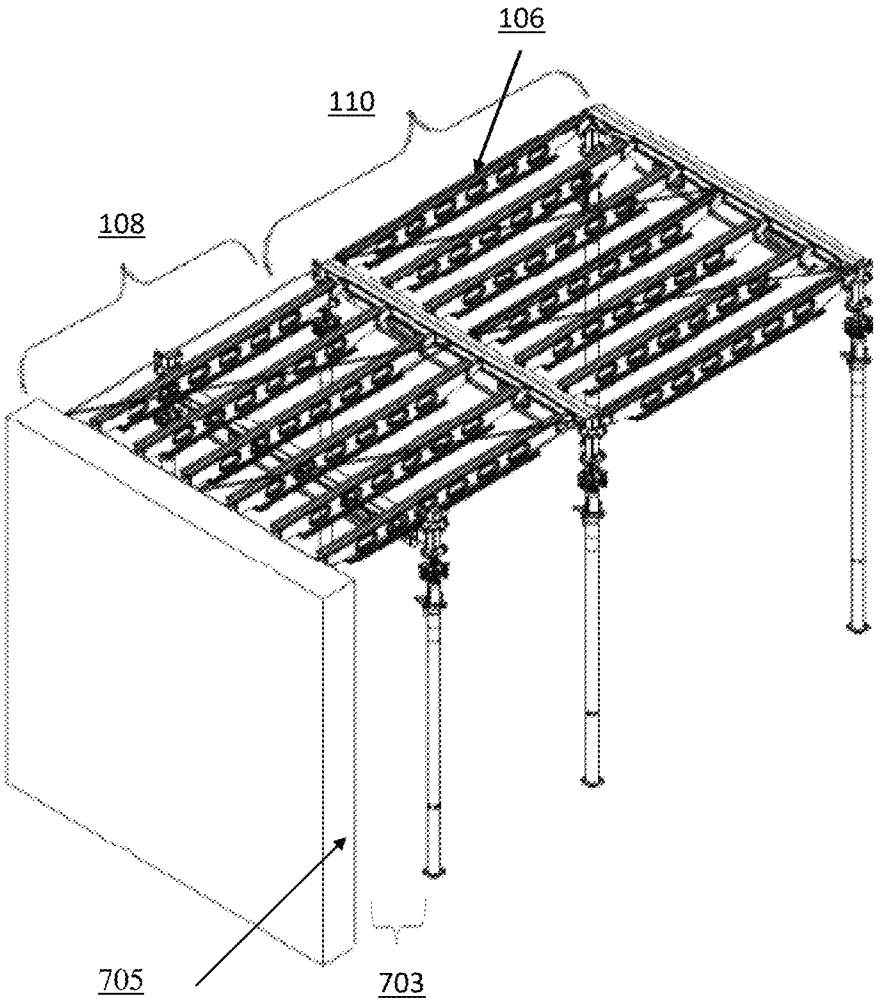
FIG. 8A illustrates a perspective view of a standard grid and a cantilever grid with an overhang with respect to a wall, according to an embodiment of the present disclosure.

Moreover, the second hook 128 and the third hook 134 enables the top of second or cantilever grid 110 to be at a same elevation with respect to the top of first or standard grid 108. The same elevation for the second or cantilever grid 110 is achieved by coupling the primary beam 104A to the third hook of the multi-level drophead unit 102 as shown in FIG. 1A and placing the secondary beams 106A on top of the primary beam 104A. Further, another end of the secondary beam 106A that includes the self-rotational locking hook 106-11 can be coupled to the lips 104-1 of the primary beam 104B. The multi-level drophead unit 102 thus allows the same primary beams 104 and secondary beams 106 to be used to build the second or cantilever grid 110 without the use of special components that are otherwise needed in currently known formworks. Moreover, the multi-level drophead unit 102 for the first or standard grid 108 to support the second or cantilever grid 110 eliminates a need for additional multi-level drophead units 102 or any drophead attachments and beams to construct the second or cantilever grid 110. In addition, the infill areas 703 may be formed with a wall 705 by the same secondary beams 106 and a wall 705 that forms the standard grid 108 and the cantilever grid 110 as shown in FIG. 8A.

Figure 10A:
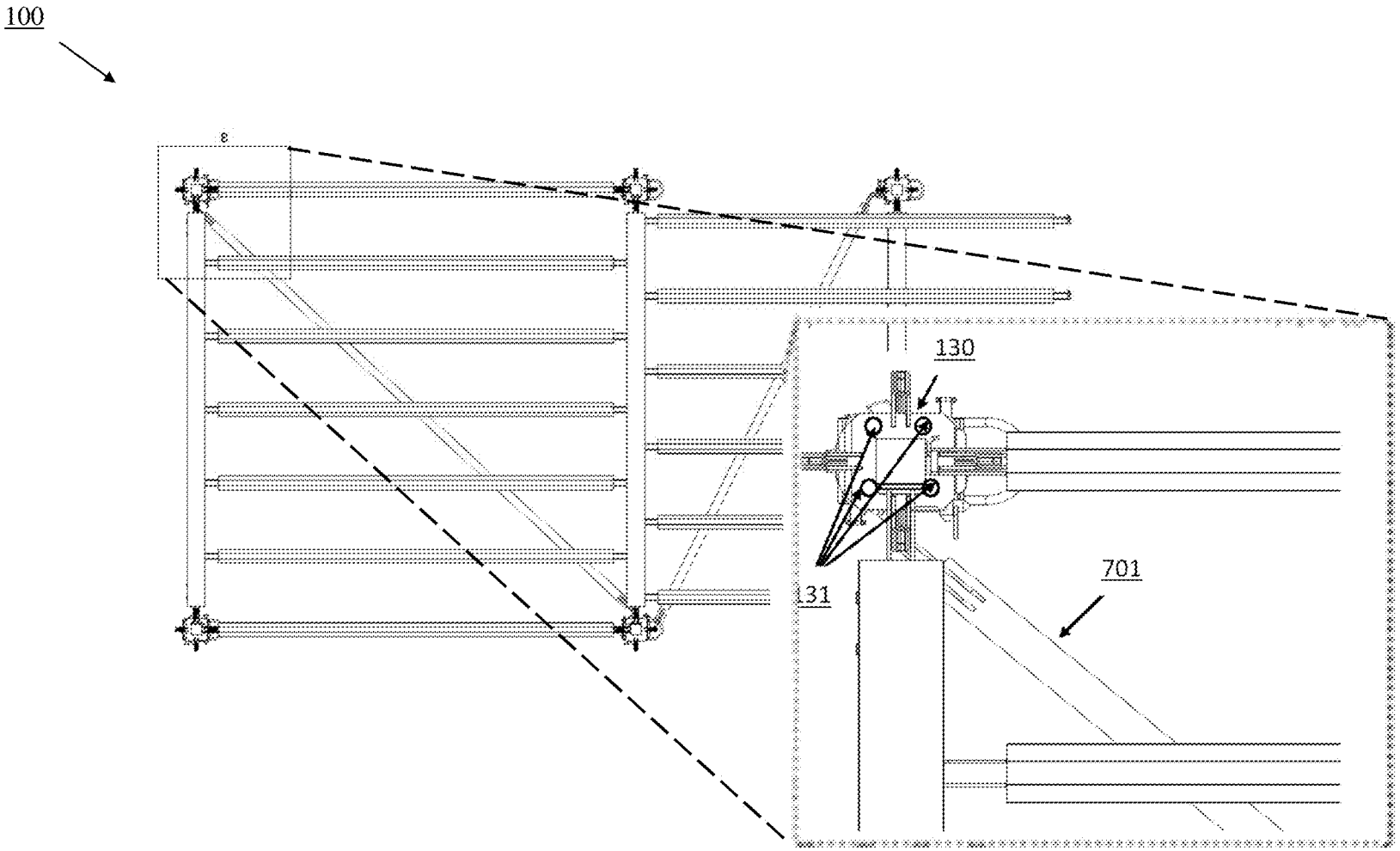
FIG. 10A illustrates a top view of the formwork of FIG. 9 with a horizontal brace, according to an embodiment of the present disclosure.
Figure 10B:
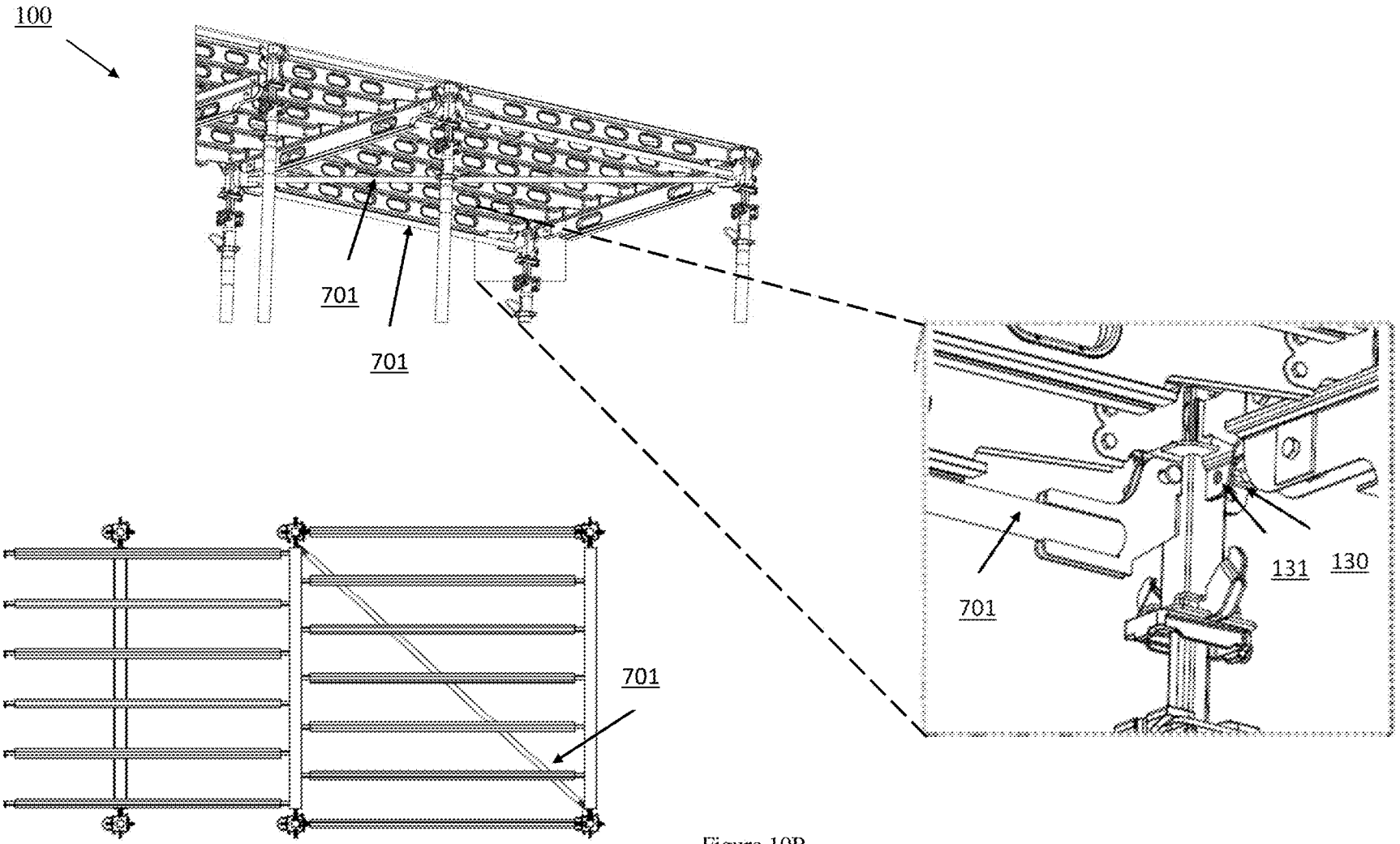
FIG. 10B illustrates different views of the formwork of FIG. 10 with a horizontal brace, according to an embodiment of the present disclosure.

In one example, the top plate 130 may include a plurality of holes 131 that may be used to attach additional components, for example, a horizontal bracing 701 as shown in FIG. 10A. The horizontal bracing 701 are employed between props 118 to give more stability to the system.

Details of the double-walled hook 104-7 and self-rotational locking hook 106-14, and the first hook 128, the second hook 128, and the third hook 134 will now be described with respect to FIGS. 3E and 3F. Current embodiment of illustrating the latching of the double-walled hook 104-7 and the first hook 128 and the structural and functional details are applicable on the second hook 128 and the third hook 134.

Referring now to FIG. 3F, the double-walled hook 104-7 may include a pair of horns 702 that may have a gap therebetween and may be adapted to the receive the mounting hook 128. In one example, the horns 702 are designed in such a way that a bottom portion of the horns 702 have a larger gap G1 while a top portion of the horn 702 have a smaller gap G2. The larger gap G1 enables easy insertion of the hook 128 while the smaller gap G2 restrict lateral play between the hook 128 and the double-walled hook 104-7. Further, each horn 702 is wider at the top portion and narrower at the bottom portion. Furthermore, each horn 702 is profiled to form a tapered surface between the larger gap G1 and the smaller gap G2 that guides the hook 128 through a valley formed between the tapered surface.

Referring now to FIG. 3E, each horn 702 may include a leg 704 that may extend from the top portion. Further, each leg 704 may be configured to rest on the top plate 130 when latched to the hook 128. Further, the double-walled hook 104-7 may be attached to the primary beam 104 using fasteners. In order to latch the double-walled hook 104-7 to the hook 128, the primary beam 104 is tilted with respect to the drophead unit 102, such that the bottom portion of the double hook 104-2 may be inserted around the hook 128 as shown in FIG. 1E (A). As the double-walled hook 104-7 is inserted around the hook 128, the tapered surfaces starting from the larger gap G1 guides the hook 128 therefrom. Once inserted, the legs 704 makes contact with the top plate 130. Thereafter, the primary beam 104 may be tilted to orient the primary beam 104 orthogonal to the drophead unit 102 as shown in FIG. 3E (B). Orienting the primary beam 104 makes the legs 704 rest completely on the top plate 130. Similar process is repeated for the other end of the primary beam 104 and another drophead unit 102.

Although the foregoing embodiment shows a solid hook design that receives the double walled hook 104-7 of the primary beam 104, the hooks can have a double walled hook design that can latch with the double walled hooks of the primary beam shown in FIG. 2C. Such an exemplary design and a manner in which is explained with respect to FIGS. 3G to 3K.

Figure 3G:
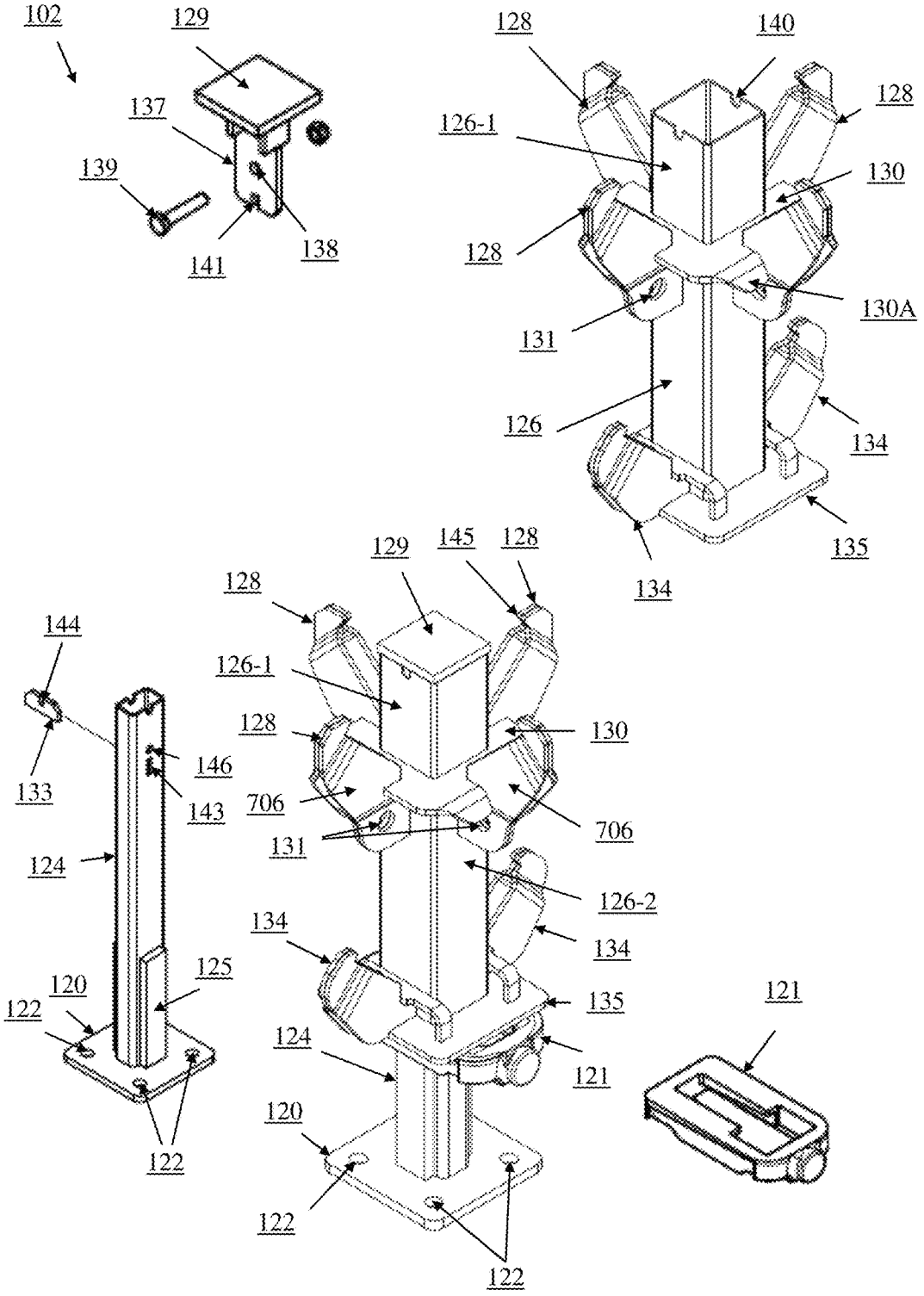
FIG. 3G illustrates an assembled and disassembled view another multi-level drophead unit with double walled hooked attachment portions that couples to the primary beam of FIG. 2C, according to an embodiment of the present disclosure.
Figure 3H:
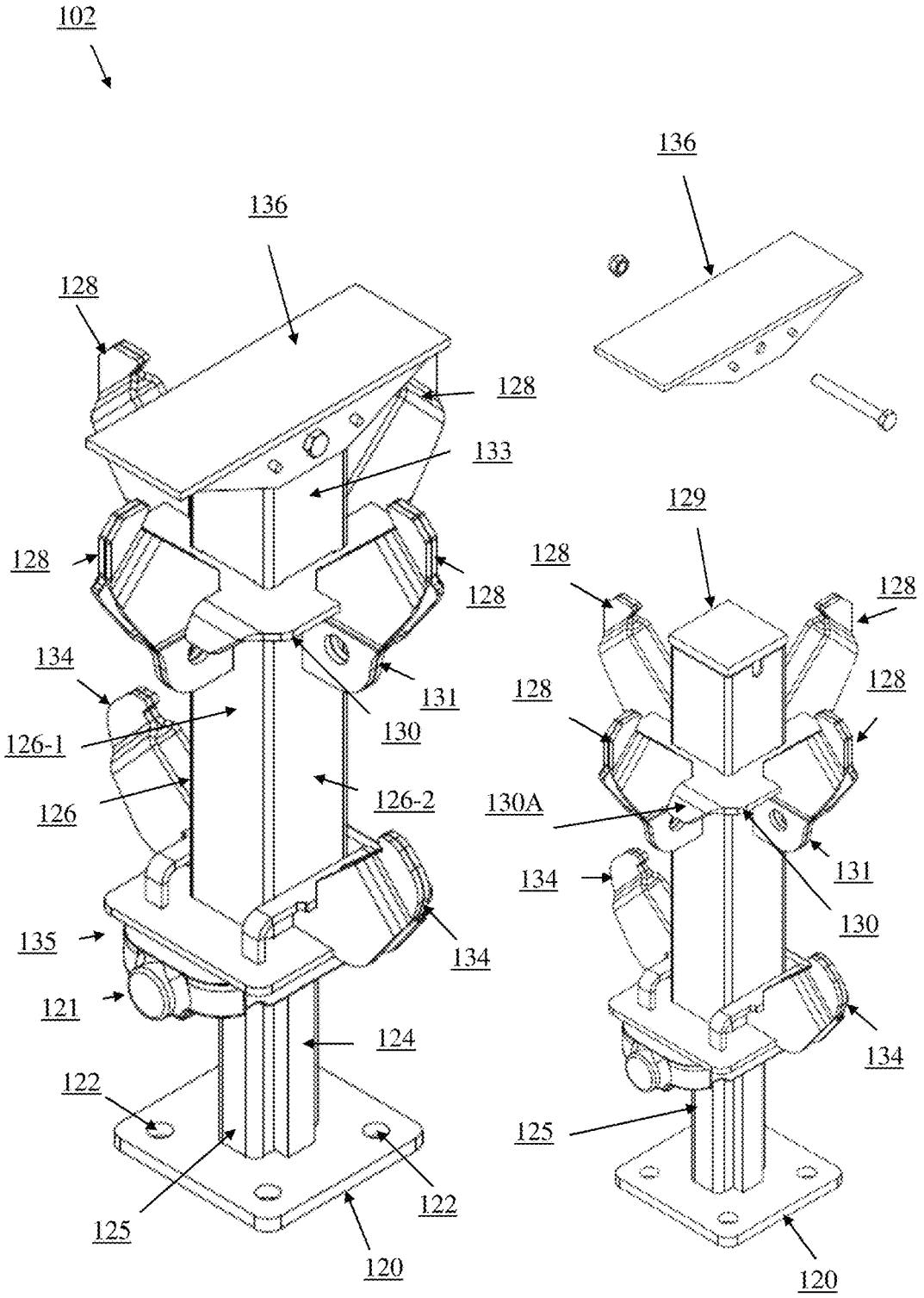
FIG. 3H illustrates the multi-level drophead unit of FIG. 3G with a drophead adapter, according to an embodiment of the present disclosure.
Figure 3I:
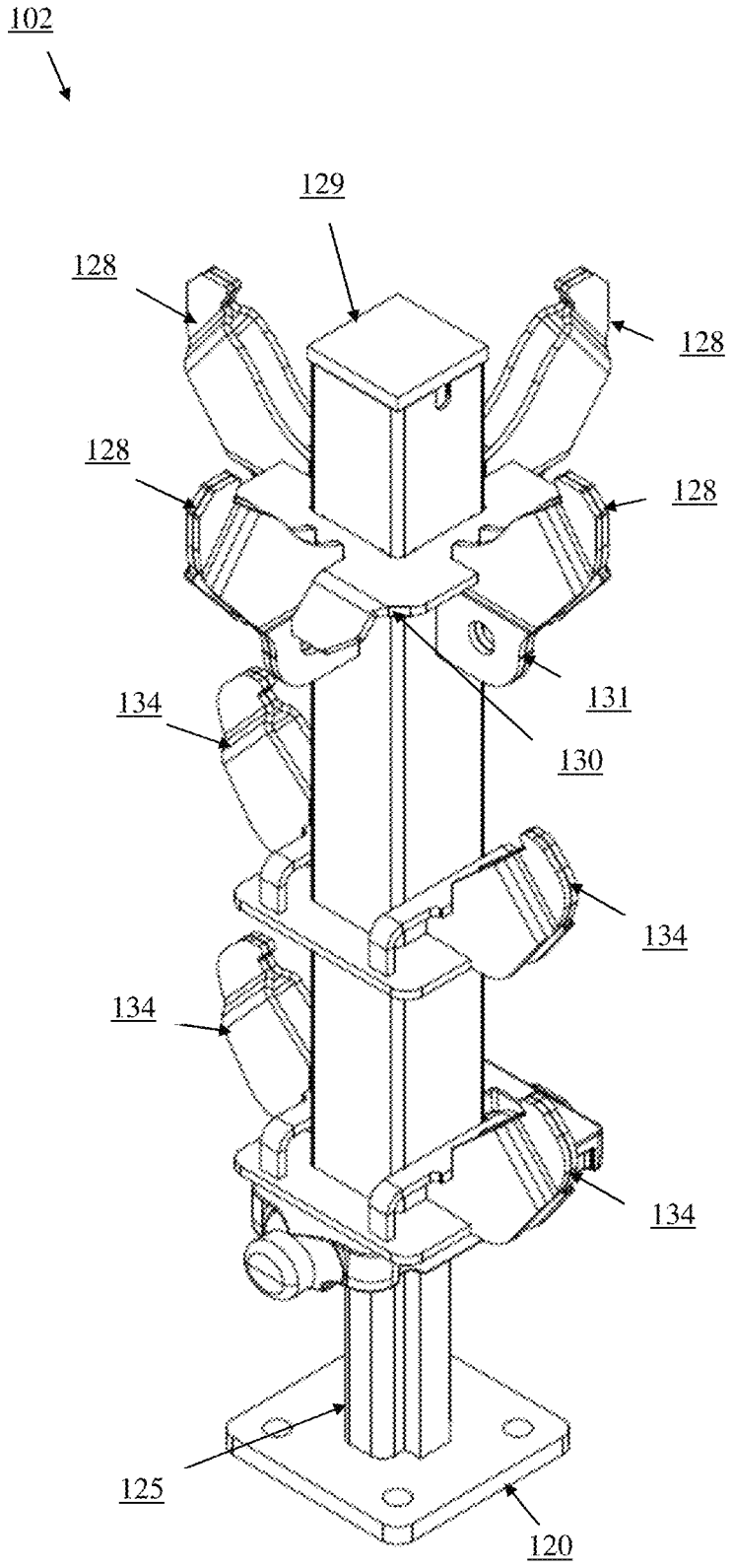
FIG. 3I illustrates the multi-level drophead unit of FIG. 3G with up to eight attachment portions, according to an embodiment of the present disclosure.
Figure 3J:
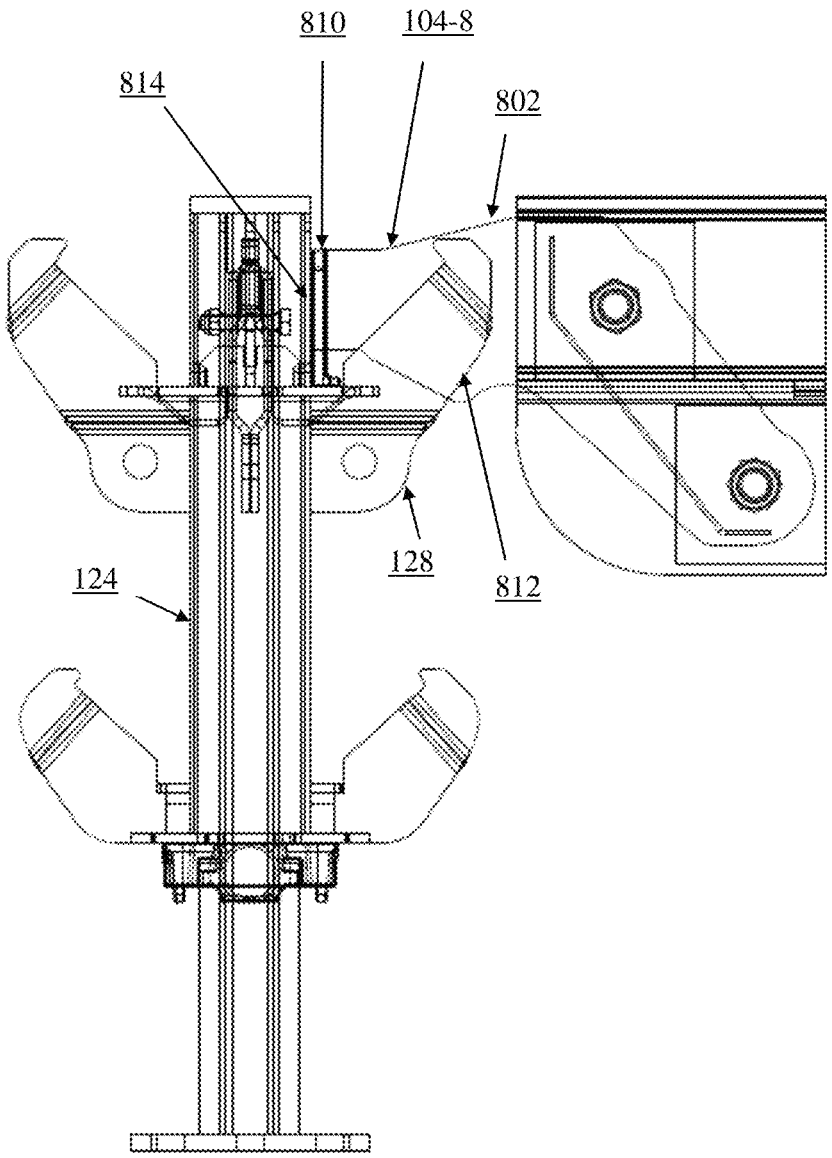
FIG. 3J illustrates side view of the multi-level drophead unit of FIG. 3G and the primary beam of FIG. 2C, according to an embodiment of the present disclosure.
Figure 3K:
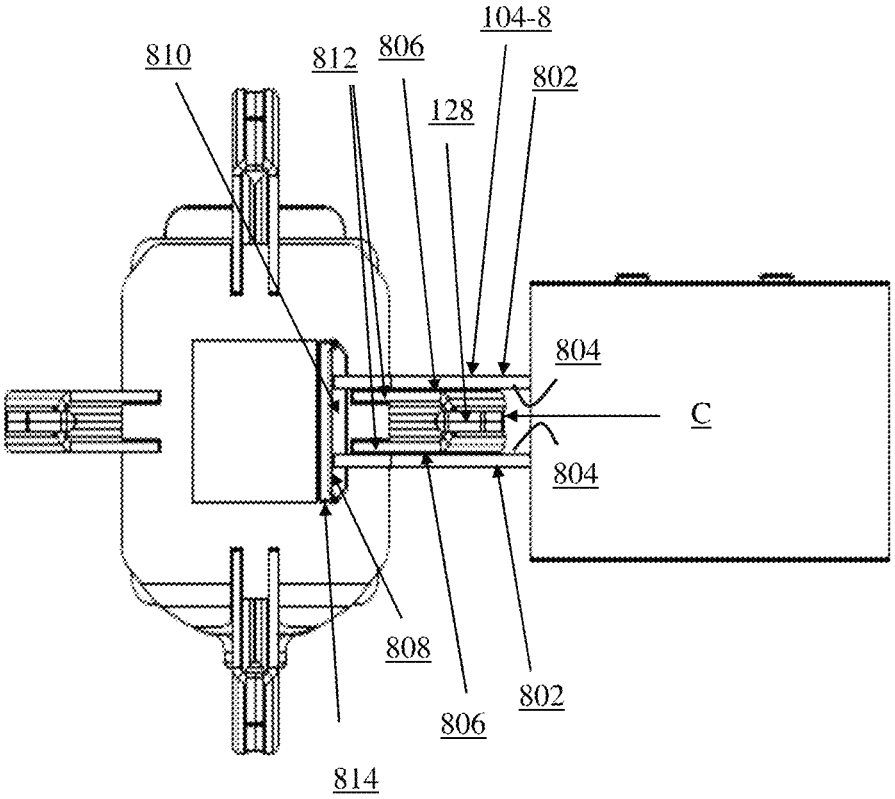
FIG. 3K illustrates top view of the multi-level drophead unit of FIG. 3G and the primary beam of FIG. 2C, according to an embodiment of the present disclosure.

Specifically, FIG. 3G illustrates an assembled and disassembled view another multi-level drophead unit 102 with double walled hooked attachment portions that couples to the primary beam 104 of FIG. 2C while FIG. 3H illustrates the multi-level drophead unit 102 of FIG. 3G with a drophead adapter. Further, FIG. 3I illustrates the multi-level drophead unit 102 of FIG. 3G with up to eight attachment portions and FIG. 3J illustrates side view of the multi-level drophead unit 102 of FIG. 3G and the primary beam of FIG. 2C. Furthermore, FIG. 3K illustrates side view of the multi-level drophead unit 102 of FIG. 3G and the primary beam 104 of FIG. 2C.

The multi-level drophead unit 102 may include a base plate 120 that may couple of the multi-level drophead unit 102 to the post or prop 118. In one example, the base plate 120 may include a plurality of holes 122 to receive fastening members to couple the multi-level drophead unit 102 to the post or prop 118.

The multi-level drophead unit 102 may also include a stem 124 attached to the base plate 120, such that the stem 124 is orthogonal to the base plate 120. The stem 124 is hollow tube have a rectangular cross section and may be configured to support the other parts of the multi-level drophead unit 102 thereon. The stem 124 has a stopper plate 133 detachably secured to the stem 124. The stem 124 has a slit 143 that receives the stopper plate 133. In one example, the multi-level drophead unit 102 may also include a flyplate tube 126 that may slide over the length of the stem 124. The flyplate tube 126 may slide along the stem 124 until the level of the stopper plate 133 and cannot move further up as a stopper mechanism of flyplate tube 126 hits the stopper plate 133. A wedge 121 is positioned over the loading plate 125 in the locked position to keep the flyplate 126 in position. When hammered during striking process, it slides down to the base plate 120 releasing the flyplate and lowering it down. The wedge has a direction nose 151 to indicate the direction of hammering for loosening. The entire assembly of 121, 124 & 126 gets interlocked with the detachable top plate 129 with bolting provision to prevent post galvanization welding of the assembly.

The flyplate tube 126 may have a rectangular or square-shaped hollow cross-section and may include a first top portion which acts as a stabiliser tube 126-1 for the grid and a second bottom portion 126-2 which creates the level difference required for the multi-level drophead unit 102. The flyplate tube 126 may include a top plate 130 that may include a hook 128 in four directions at a first level. Each hook 128 includes a cut-portion of a pre-defined shape to receive and secure a primary beam end hook 104-8 or secondary beam connecting members 106-1 (shown in FIG. 2C). In one example, the method of locking the wedge 121 and the flyplate in the drophead stem along with a stopper plate to ensure position of the flyplate is described. On the vertical stem 124, the wedge 121 is inserted with its longer side parallel to longer side of the stem 124 so as to seat on the loading plate 125. The wedge is provided with a nose 151 to indicate the direction of loosening. Above this, the flyplate is assembled with the extended portion 130A in the same direction of the nose 151 of the wedge 121 to ensure beam hooked in this position does not accidentally dislodge the wedge 121. After this assembly, the stopper plate 133 is inserted in the slot 143 of the vertical stem 124 which keeps the top plate 130 of the flyplate in desired position. After this, to lock the entire assembly, the drophead top member 129 is assembled. The drophead top member 129 has an extension plate 137 as shown in FIG. 3G. The extension plate 137 also have a cut-out notch 141 at one of its ends. The notch 141 inserts into a groove 144 of the stopper plate 133 to secure the stopper plate 133 in its position. The drophead top member 129 is fastened to the vertical stem 124 by using a fastener 139 which passes through the hole 138 of the extension plate 127 and also the hole 146 of the stem 124.

The flyplate tube 126 may include another set of hooks 134 on the bottom plate 135 of the flyplate tube 126 at a second level, such that the first level is different from the first level. The bottom plate 135 will be at a different level with reference to the top plate 130 of the flyplate tube to facilitate hooking provisions at multiple levels. In one example, the spacing between the two levels may be equal to the depth of the secondary beam 106. The hooks 128 & 134 at all levels are also configured to receive and secure the double-walled end hook 104-8 of the primary beam 104 at the two different levels as required in the standard or cantilever grids. Also, the hooks are designed in such a way that it will avoid the tilting of primary beam 104 during erection. Further, the hooks 128 & 134 are configured to also receive and secure the rotational lock 106-1 of the secondary beam 106.

Further, the hooks 128 and 134 includes a lip 145 on their tip that prevent accidental dislodging of the primary beam 104 and secondary beam 106 during erection. The lips 145 are provided with tapered ends for easy entry of the double walled end hook 104-8 of the primary beam 104 and the secondary beam 106. Moreover, the side-face surface of the hooks 128, 134, acts as a stabilising surface which prevents tilting of the primary beam 104 and the secondary beam 106 once they are coupled to the drophead unit 102.

In one example, the hooks 128 & 134 enable the multi-level drophead unit 102 to have six attachments point over four attachments point in the currently known drophead units, thereby enabling versatility of the multi-level drophead unit 102 for making the first formwork 100. Specifically, the set of hooks 128 provide four attachments points at a first level or top level while the pair of hooks 134 provide two attachments points at a second level or bottom level different from the first level or the top level. In one example, the first level and the second level could be spaced by a distance which is equal to the depth of the secondary beam 106. Although the present illustration shows the number of hooks 134 as two, additional number of hooks 134 may also be used thereby increasing the total count of coupling to eight or even twelve by adding another layer of hooks in-between as shown in FIG. 3I. Additional or lesser number of hooks can be envisioned without departing from the scope of the present disclosure.

Moreover, a pair of hooks 128 and the hooks 134 enable the top of second or cantilever grid 110 to be at a same elevation with respect to the top of first or standard grid 108. The same elevation for the second or cantilever grid 110 is achieved by coupling the primary beam 104A to the hooks 134 of the multi-level drophead unit 102 as shown in FIG. 1A and placing the secondary beams 106A on top of the primary beam 104A. Further, another end of the secondary beam 106A that includes the specially designed self-rotational hooks 106-1 can be coupled to the lips 104-1 of the primary beam 104B. The multi-level drophead unit 102 thus allows the same primary beams 104 and secondary beams 106 to be used to build the second or cantilever grid 110 without the use of special components that are otherwise needed in currently known formworks. Moreover, the multi-level drophead unit 102 for the first or standard grid 108 to support the second or cantilever grid 110 eliminates a need for additional drophead units 102 or any drophead attachments and beams to construct the second or cantilever grid 110. In addition, the hooks 134 may be used to form infill areas with the same secondary beams 106 that forms the standard grid 108 and the cantilever grid 110.

In one example, the hooks 128 may include a plurality of holes 131 that may be used to attach additional accessory like, a wind clip, a chain, and a horizontal bracing 701 as shown in FIG. 10A to give additional stability to the grid. Also, these holes 131 can be used to attach the conventional anchoring mechanisms to the floor slab below.

FIG. 3J & FIG. 3K illustrates the stabilisation mechanism achieved using the primary and secondary beams when coupled to the drophead. The primary beam has double-walled end hook 104-8 and secondary beams 106 have double-walled end hook 106-12 which are also double-walled. The drophead hooks 128 and 134 are designed to fit into the cavity formed within the double-walls of these end hooks 104-3 or 106-1. Specifically, FIG. 3J shows a side view of the drophead unit 102 showing the hooking of the double-walled end hook 104-8 to the hook 128 while FIG. 3K shows a top view of the of the double-walled end hook 104-8 mounted on to the hook 128. The drophead unit 102 creates two interfaces when assembled with primary/secondary beam end hooks which gives stability for the grid against swaying and tilting. Current embodiment of illustrating the hooking of the double-walled end hook 104-8 and the hook 128 and the structural and functional details are also applicable on the hook 134.

The double-walled end hook 104-8 may include a pair of side walls 802 that may have a cavity C (shown in FIG. 3K) there between and may be adapted to the receive the hook 128. The double walled end hook 104-3 includes a front wall 810 extending on either ends of side walls 802. In one example, the side walls 802 are designed in such a way that inner surface 804 of the side walls 802 which snugly fits into the surface of the outer walls 806 of the hooks 128 creating an interference area 812. Also, an external end face 808 of the front wall 810 may abut the outer face of the top portion i.e. stabiliser tube 126-1 of the drophead flyplate tube 126 creating another interference area 814. As shown in FIGS. 3J and 3K, portions of the outer wall 806 of the hooks 128 mating with portions of the side walls 802 of the double walled end hook 104-3 forms a first contact area 812 which provides stability against tilting of the primary beam 104. On the other hand, as shown in FIG. 3K, the external surface 808 of the front wall 810 of the double-walled end hook 104-8 abuts with the portions of the outer face of the top portion i.e. stabiliser tube 126-1 of the drophead flyplate tube 126 and forms a second contact area 814. The second contact area 814 provides stability against swaying of the primary beam 104. Once this above sequence is done for creating an opposite pair of primary beams 104, secondary beams 106 are coupled between this pair of primary beams 104 to complete a grid as shown in formwork 100. The first contact area 812 and the second contact area 814 ensures a stable primary beam when coupled with secondary beams 106 connected as a rigid grid thereby giving self-stability to the formwork 100.

According to the present disclosure, the formwork can be designed in such a way that the formwork can be struck early without plywood trapping or in other words, prevent trapping of the first sheathing member 112 and the second sheathing member 114.*s* Such an arrangement enables the removal of the secondary beam 106 and the secondary beam adapter 116 to transfer the complete load of the concrete slab on the props 118. Accordingly, the secondary beam adapter 116 enables an operator to disassemble some of the primary beams 104, the secondary beam 106, and the first sheathing members 112 when the concrete has partially cured thereby alleviating a need to keep the first or standard grid 108 assembled. Such enabled disassembly of the first or standard grid 108 enables multiple uses of the same set of components to build an additional structure.

Figure 4A:
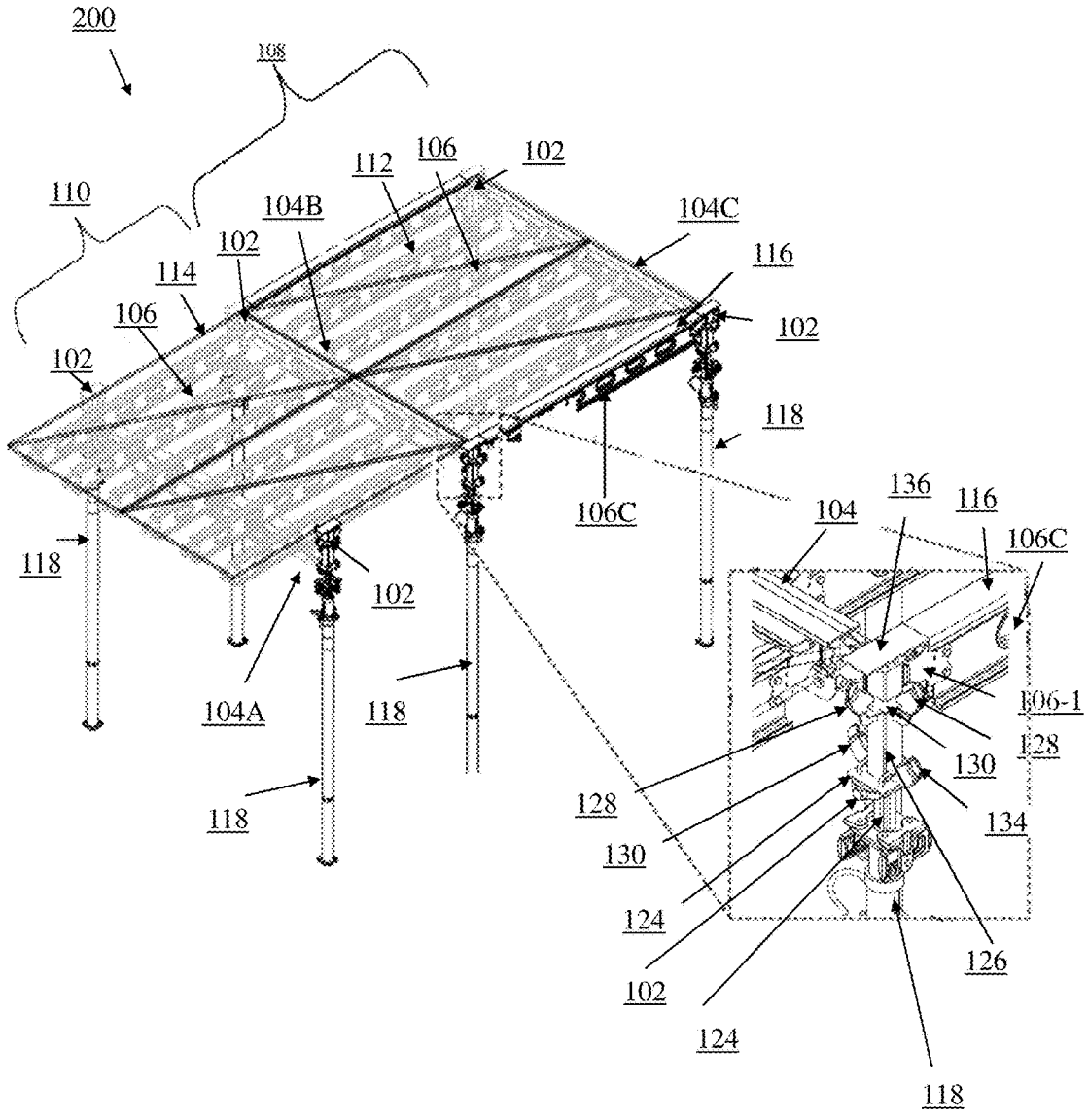
FIG. 4A shows a perspective view of a formwork in an early striking scenario without plywood trapping using a secondary beam adaptor, according to an embodiment of the present disclosure.
Figure 4B:
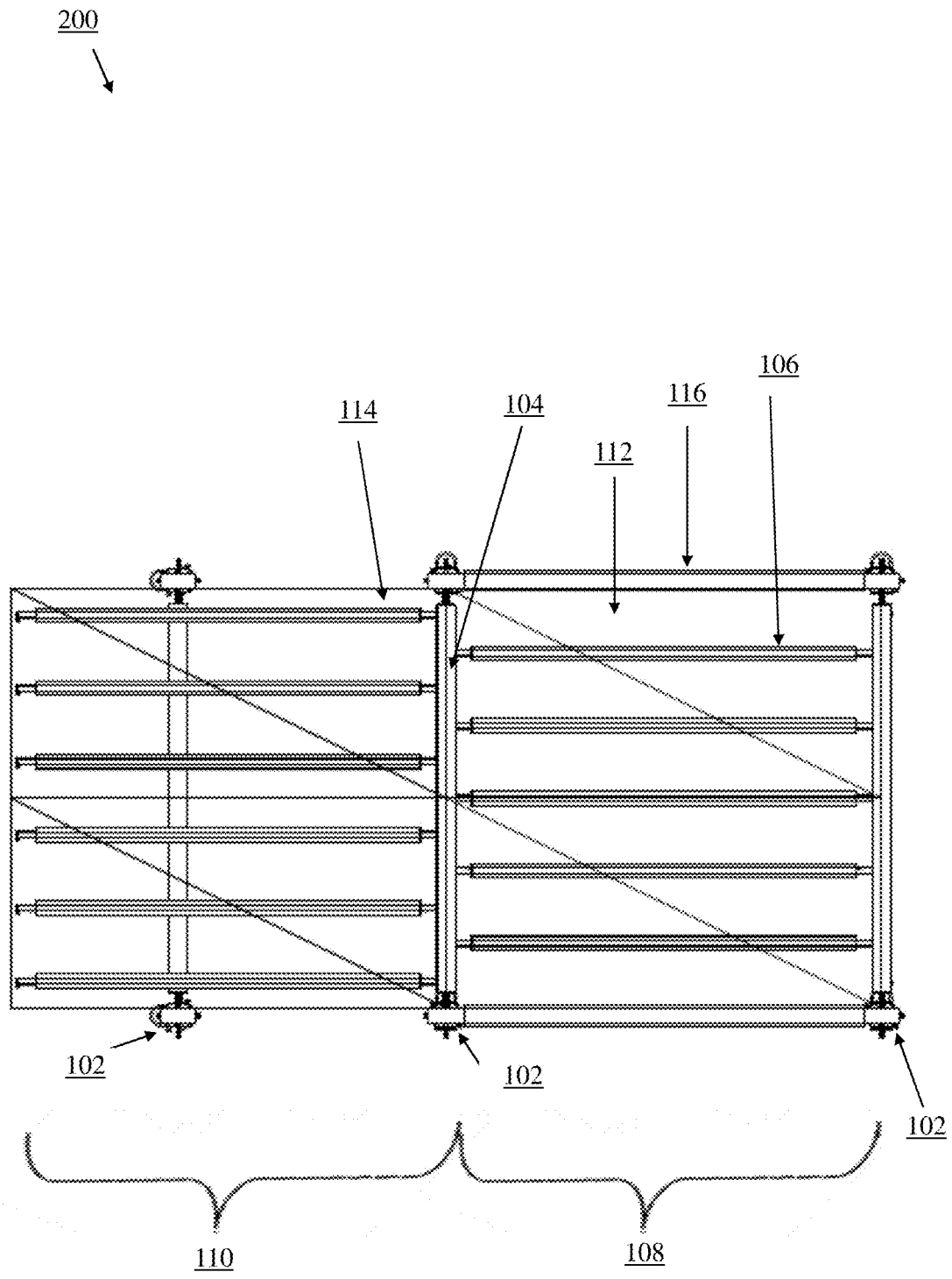
FIG. 4B illustrates a top view of the formwork in an early striking scenario without plywood trapping using the secondary beam adaptor, according to an embodiment of the present disclosure.

FIGS. 4A and 4B illustrates a second formwork 200 which is an extension of first formwork 100 wherein the plywood entrapment is avoided by usage of two additional adaptors in addition to the existing components used in first formwork 100. When the arrangement is used as in first formwork 100, the plywood sheathing 112 which will pass over the drophead 102 will get entrapped between the concrete and the drophead top plate. One of the methods to avoid this situation of passing of the plywood 112 over the drophead 102 is to avoid passing of the plywood over the secondary beam 106 and the drophead 102. For this purpose, the second formwork 200 may include a secondary beam adapter 116 that may be coupled to the secondary beam 106C at the drophead location and a drophead adaptor 136 over the drophead 102 adjacent to the secondary beam adaptor 116. The secondary beam adapter 116 together with the drophead adaptor 136 helps in avoiding the plywood entrapment during early striking of the second formwork 200 and allows the prop 118 with drophead 102 and drophead adaptor 136 to be left in place post de-shuttering.

Figure 4C:
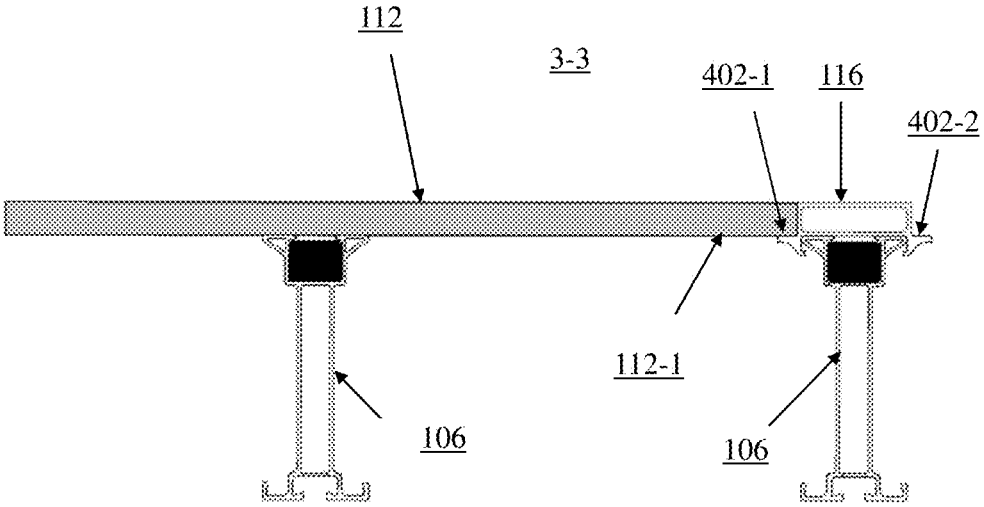
FIG. 4C illustrates an arrangement of the secondary beam adaptor and a cross section of the secondary beam adapter, according to an embodiment of the present disclosure.
Figure 4C:
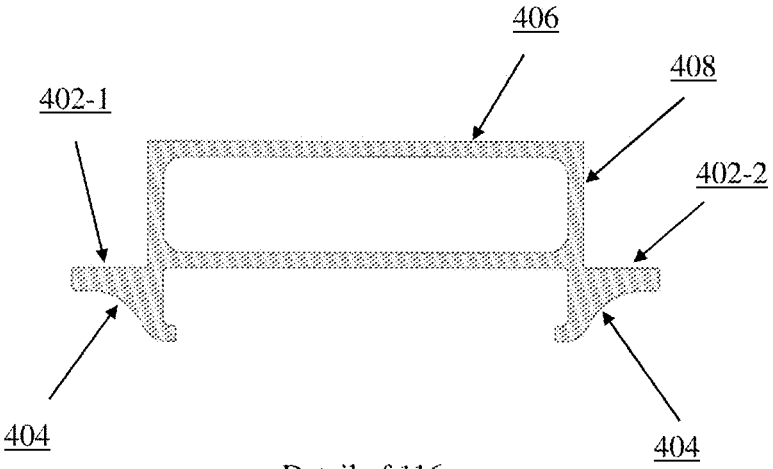

Details of the secondary beam adapter 116 are explained with respect to FIG. 4C. Referring now to FIG. 4C that illustrates cut sections taken along lines 3-3 in FIG. 4A, according to an embodiment of the present disclosure. The secondary beam adapter 116 may be made of a material suitable to bear the load of the first sheathing members 112 and poured concrete. As shown in cut sections 3-3 and the details of secondary beam adapter 116, the secondary beam adapter 116 may have a hollow cuboid shaped body with a rectangular cross-section at top and may include a pair of flanges 402-1 and 402-2 on either side 404 of the secondary beam adapter 116. The flanges 402-1, 402-2 are adapted to receive a bottom surface 112-1 of the first sheathing member 112. The secondary beam adapter 116 may include a vertical section 408 defining its thickness and extends above the flange 402-1, 402-2 whose height is defined as equal to the thickness of the sheathing member. The thickness 408 of the secondary beam adapter 116 can be changed to suit the first sheathing members 112 of any thickness which gives the flexibility to the operator to use different thickness of the first sheathing members 112 available to the operator. Moreover, the drophead adaptor 136 (shown in FIG. 3D) is also coplanar with a top surface 406 of the secondary beam adapter 116 as well as the plywood sheathing 112. These three in combination with the drophead adaptor 136, plywood sheathing 112 and secondary beam adaptor 116 helps to achieve a continuous flat surface on the top.

In one example, the flanges 402-1, 402-2 are configured to allow mounting of the first sheathing member 112 on either side of the secondary beam 106 thereby preventing the plywood entrapment over the drophead. Such an arrangement enables the removal of the plywood 112 along with the secondary beam 106 and the secondary beam adapter 116 during early de-shuttering without any entrapment. The drophead adaptor 136 remains on top of the drophead and remains stuck to concrete while all other members can be removed during de-shuttering.

According to the present disclosure, details of the drophead adaptor 136 are explained in FIG. 3H. The drophead unit 102 can be fitted with an additional adaptor 136 over the top member 129 as shown in FIG. 3H. Referring now to FIG. 3H, the multi-level drophead unit 102 may be attached with a drophead adaptor 136 over the top member 129 on the stem 124. The top surface of the drophead adaptor 136 may be configured to be in flush with the top of the first sheathing member 112 and the top surface 406 of the secondary beam adaptor 116. Such a placement allows for a flat surface for uncured concrete.

According to the present disclosure, the multi-level drophead unit 102 with the top member 129 may be used in normal scenario as shown in FIG. 1A where early striking with plywood trapping is allowed. However, the multi-level drophead unit 102 with the drophead adaptor 136 may be used in early striking scenario without plywood trapping. During de-shuttering, the primary beams 104, the secondary beams 106, and the sheathing members 112, 114 may be removed while the props 118, drophead 102 and the drophead adaptor 136 remain in position when the concrete has achieved required strength to support its own weight.

Figure 5A:
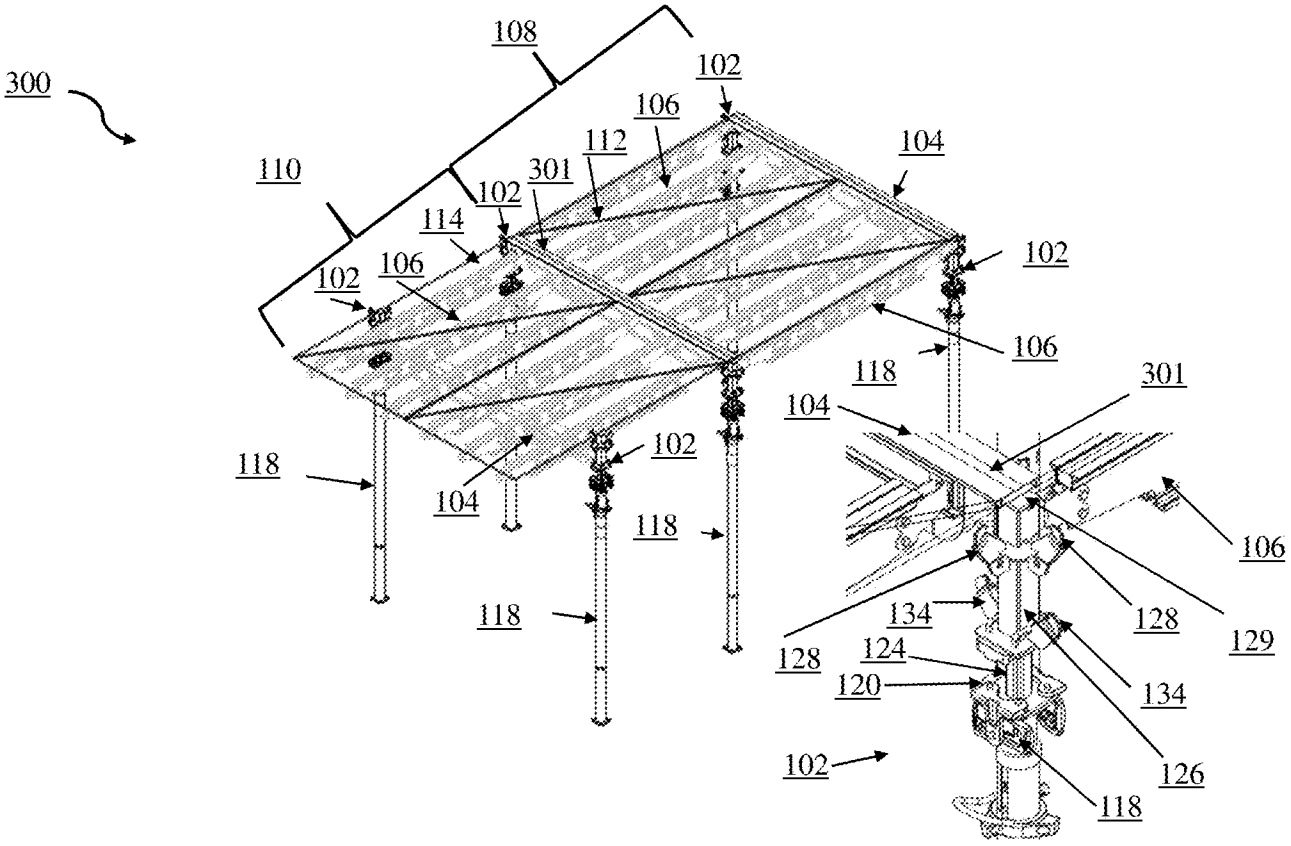
FIG. 5A shows a perspective view of a formwork in an early striking scenario without plywood trapping using a closure beam, according to an embodiment of the present disclosure.

FIG. 5A illustrates a third formwork 300 which is an extension of first formwork 100 wherein the plywood entrapment is avoided by usage an additional closure beam in addition to the existing components used in first formwork 100. When the arrangement is used as in first formwork 100, the plywood sheathing 112 which will pass over the drophead 102 will get entrapped between the concrete and the drophead top member 129. A second method to avoid this situation of passing of the plywood 112 over the drophead 102 is to create a gap, which is equal to the dimension of the drophead top member 129, in the joint between two plywood sheets coming over a primary beam. For this purpose, the third formwork 300 may include a closure beam 301 that may be placed in the plywood joint over the primary beam 104. This closure beam will pass over the drophead top member 129. The closure beam 301 will get entrapped between the concrete and drophead top member 129 during early striking of the third formwork 300 and allows the prop 118 with drophead 102 and closure beam 301 to be left in place post de-shuttering thus avoiding plywood entrapment.

Figure 5B:
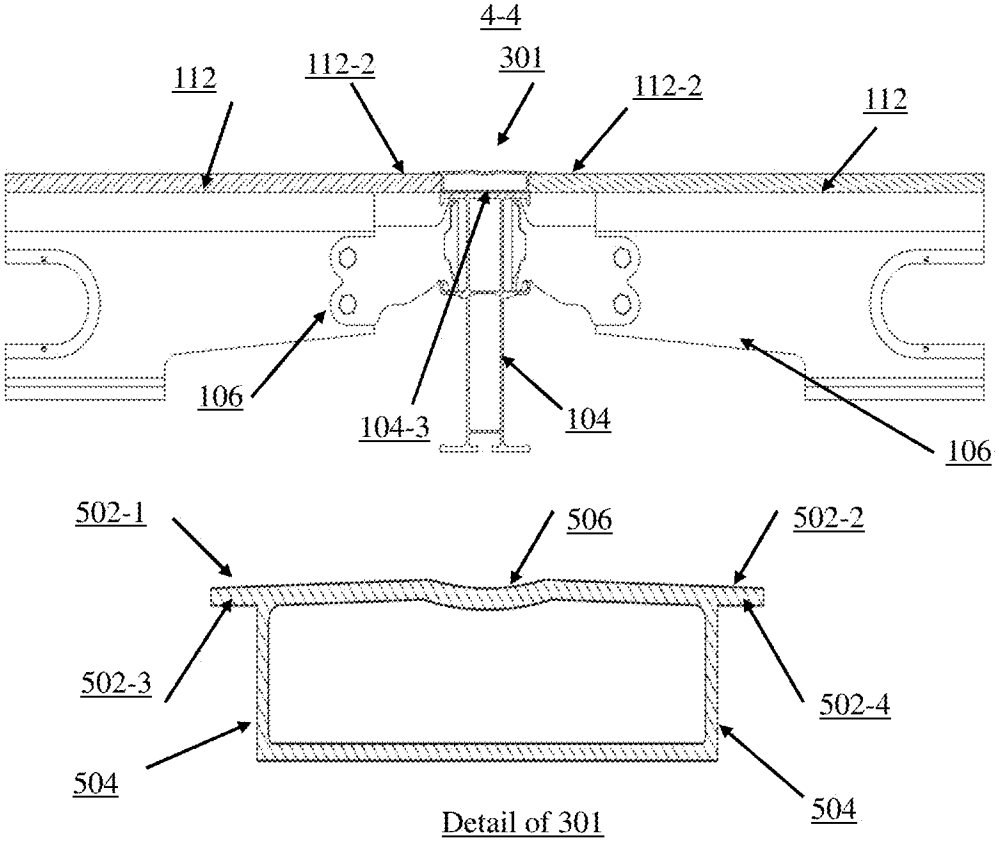
FIG. 5B illustrates an arrangement of the closure beam and a cross section of the closure beam, according to an embodiment of the present disclosure.

Details of the closure beam 301 are explained with respect to FIG. 5B. According to the present disclosure, the closure beam 301 enables early striking without trapping of the sheathing members 112, 114 by the primary beams 104 and secondary beams 106. FIG. 3B illustrates cut sections taken along lines 4-4 in FIG. 3A for illustrating closure beam 301. The closure beam 301 may have a rectangular cross-section and flanges 502-1 and 502-2 on either side 504 of the closure beam 301. Further, the closure beam 301 may be installed inside the groove 404-3 formed between adjacent sheathing members 112. In addition, the depth of the sides 504 of the closure beam 301 may be equal to or less than the thickness of the first sheathing member 112. Moreover, the flanges 502-1, 502-2 may include bottom surfaces 502-3, 502-4 respectively, and adapted to receive a top surface 112-2 of the first sheathing member 112 to prevent any gap between the first sheathing member 112 and the primary beam 104 when the uncured concrete is poured. Further, the closure beam 301 is spanning over the drophead top member 129 thereby preventing passing of the sheathing member 112 over the drophead thus avoiding entrapment. Moreover, the primary beam 104, the first sheathing members 112, and the secondary beam 106 can be removed resulting in the transfer of the load of the partially cured concrete to the prop 118 (shown in FIG. 5A).

The present disclosure also relates to a method of building a formwork. The order in which the method steps are described below is not intended to be construed as a limitation, and any number of the described method steps can be combined in any appropriate order to execute the method or an alternative method. Additionally, individual steps may be deleted from the method without departing from the spirit and scope of the subject matter described herein. The following method is explained with respect to the first formwork 100 shown in FIGS. 1A and 2A and the same method is applicable to construct the second formwork 200 and the third formwork 300.

The method may begin at a step of coupling the multi-level drophead units 102 to the props 118. Once the multi-level drophead units 102 are coupled to the props 118, the method may proceed to the step of erecting the props 118. Referring now to FIG. 1A, a set of four props 118A to 118D are erected and stabilised using erection aids such as bracing frames forming a square or rectangular pattern as shown in FIG. 1A.

The method may then proceed to the step of coupling the primary beam 104C to the first prop 118A and the second prop 118B. In one example, the double-walled end hook 104-8 at one end of the primary beam 104C is coupled to the hook 128 of the multi-level drophead unit 102 on the first prop 118A and the other end may have the other double-walled end hook which may be lifted by an erecting aid, and may be coupled to the hook 128 of the multi-level drophead unit 102 on the second prop 118B. Once the primary beam 104C is supported on the first prop 118A and the second prop 118B, the primary beam 104B may be coupled and supported to the third prop 118C and fourth prop 118D in the same way as the primary beam 104C is supported by the first prop 118A and the second prop 118B.

The method may now proceed to the step of mounting the secondary beam 106C on the drophead. In order to mount the secondary beam 106C, one end having of the secondary beam 106C having one of the double-walled end hook 106-12 may be coupled to the hook 128 of the multi-level drophead unit 102 on the second prop 118B. Once coupled, the other end may be lifted using and erecting aid to couple the double-walled end hook 106-12 on the other end to the hook 128 of the multi-level drophead unit 102 on the fourth prop 118D.

Figure 6A:
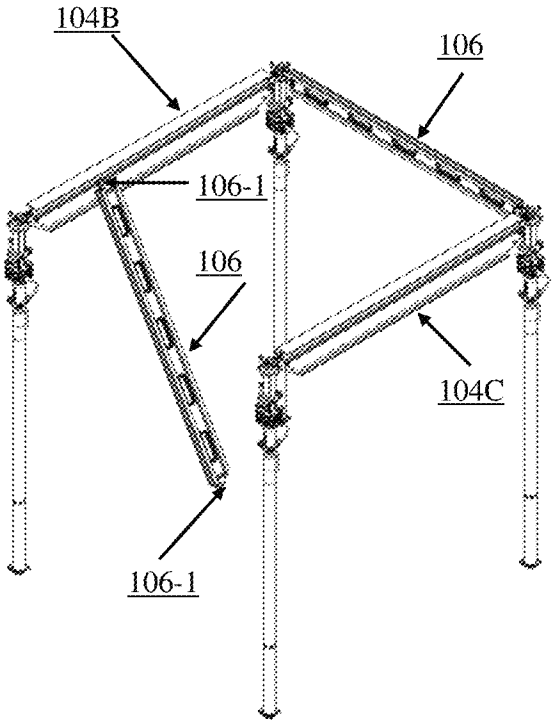
FIG. 6A illustrates mounting of one end of the secondary beam of FIG. 3D to the primary beam of FIG. 2C, according to an embodiment of the present disclosure.
Figure 6B:
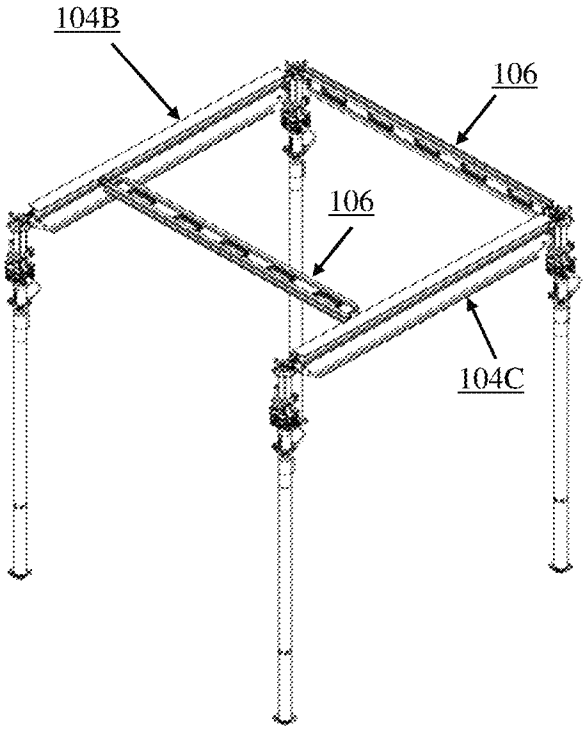
FIG. 6B illustrates mounting of another end of the secondary beam of FIG. 3D to the primary beam of FIG. 2C, according to an embodiment of the present disclosure.

The aforementioned steps are elaborated in conjunction with FIGS. 6A to 6B in conjunction with FIGS. 2C and 2D. FIG. 6A explains the first step of mounting secondary beam 106 on the cavity 104-4 of the primary beam 104B wherein the secondary beam 106 may be oriented flat with its depth parallel to the length of the primary beam 104B. As shown in FIG. 6A, one of the double-walled end hook 106-12 may be hooked into the latching cavity 104-4 (refer FIG. 1B) so that the hook 106-10 gets locked into the bottom lip 104-1 of the cavity 104-4. The concept of the orienting the beam flat is more secure than the conventional way of orienting the beam upright into the cavity which has a risk of falling down. In the event of beam accidentally left alone without support, the shape of the hook 106-10 gives a provision for the beam to freely hang vertically downwards without any chance of disengagement from the cavity even without the use of any special stopper mechanisms as required in other conventional methods.

Figure 6C:
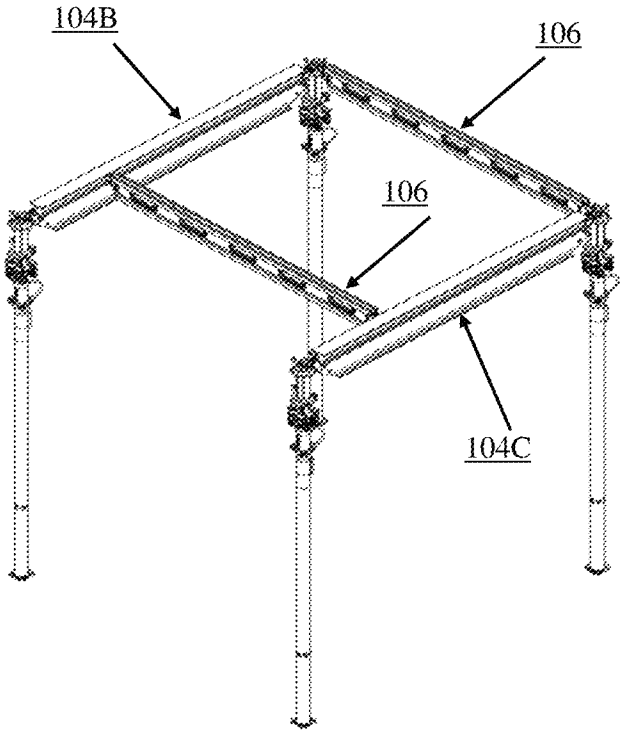
FIG. 6C illustrates the rotation of the secondary beam of FIG. 3D under gravity, according to an embodiment of the present disclosure.

As shown in the FIG. 6B, once the hook 106-1 of one end is hooked in position, the secondary beam 106 can be swung up so that the hook 106-1 on the other end may then be placed into the cavity 104-4 of the opposite primary beam 104, making the secondary beam 106 horizontal. As shown in FIG. 6C, the beam which is in placed in flat orientation automatically swings down to an upright position by virtue of its own weight due to the specific positioning of the centre of gravity created by the double-walled end hook 106-12.

Once the secondary beam 106 assumes the vertical orientation, the specially designed end hooks 106-1 on both ends of the secondary beam 106 gets locked in the latching cavity 104-4, such that the movement in the horizontal as well as vertical direction of the end hooks 106-1 is restricted by the top downward lip 104-1 of the locking cavity 104-4 as shown in FIG. 6C with a minimal play. This prevents inadvertent dislodgement of the secondary beam 106 with respect to the primary beam 104. The same specially designed end hooks 106-1 can be used to install the secondary beam 106C into the flyplate hook 128 or 134 of the multi-level drophead directly in an upright position similar to a primary beam 104. There is a plurality of slots 106-5 encased with polymer caps 106-6 which have projections that allow to get press-fit to the web of the secondary beam 106. Also, the slots provide space for holding the secondary beams during handling as well as act as a hooking point for the erection aid. The caps 106-6 act as handle grip avoiding sharp edge of the slots as well as prevent any entry of foreign particles into the beam through the slots.

Figure 7:
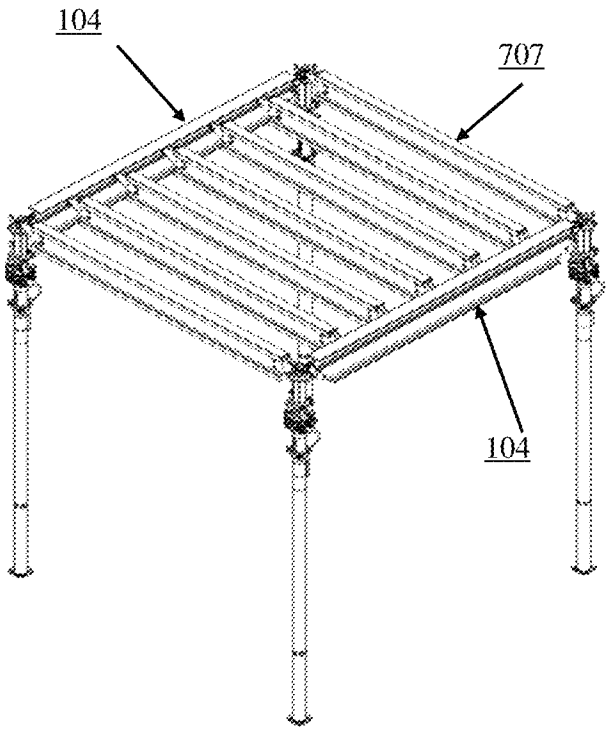
FIG. 7 illustrates a first grid constructed using timber secondary beam, according to an embodiment of the present disclosure.

As shown in FIG. 7, the first formwork 100 also allows use of standard timber formwork beams or timber joists 707 in place of extruded aluminium sections of secondary beams 106 in combination with the specially designed end hooks 106-1.

Figure 8B:
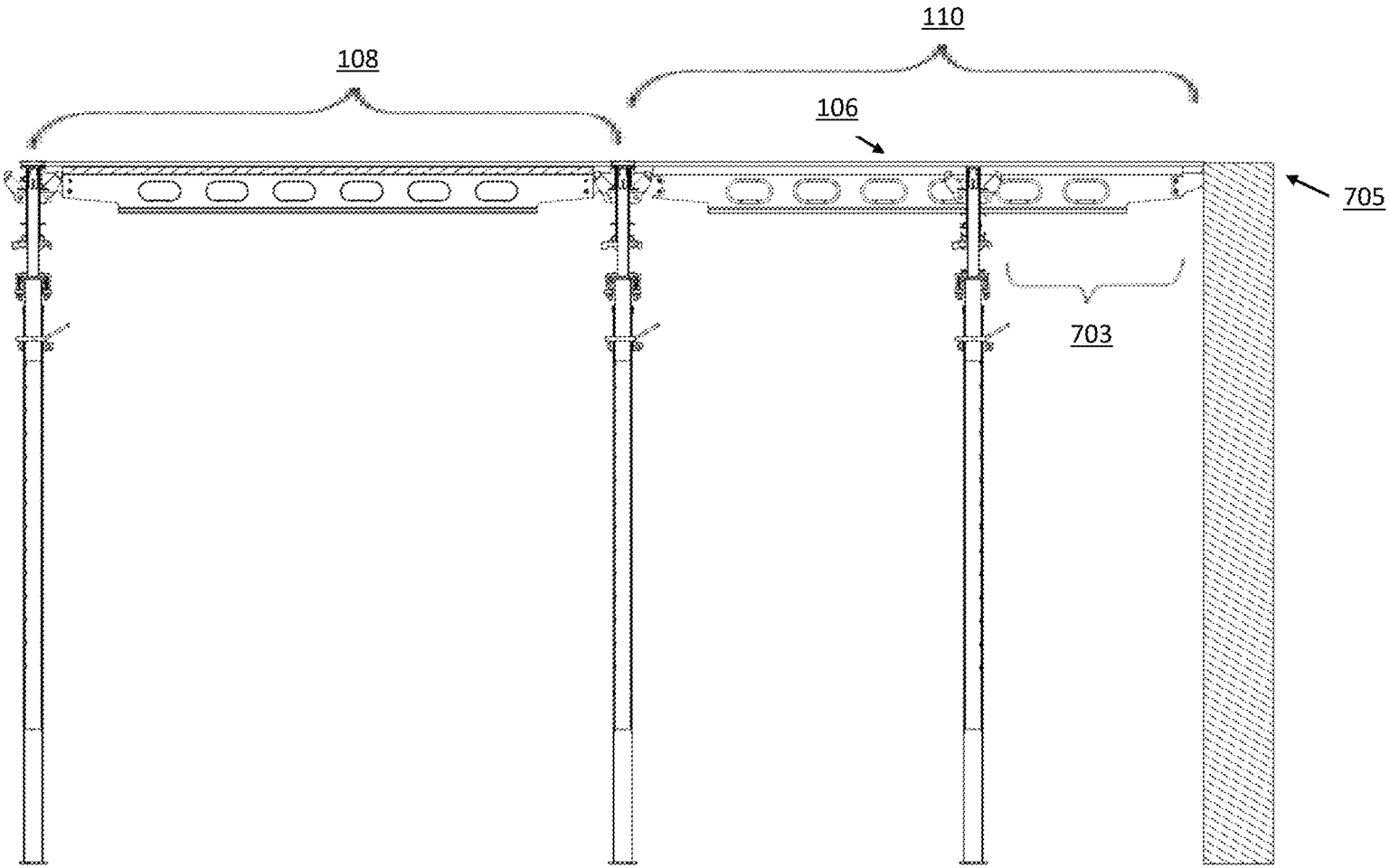
FIG. 8B illustrates a side view of the standard grid and the cantilever grid with an overhang with respect to a wall, according to an embodiment of the present disclosure.
Figure 9:
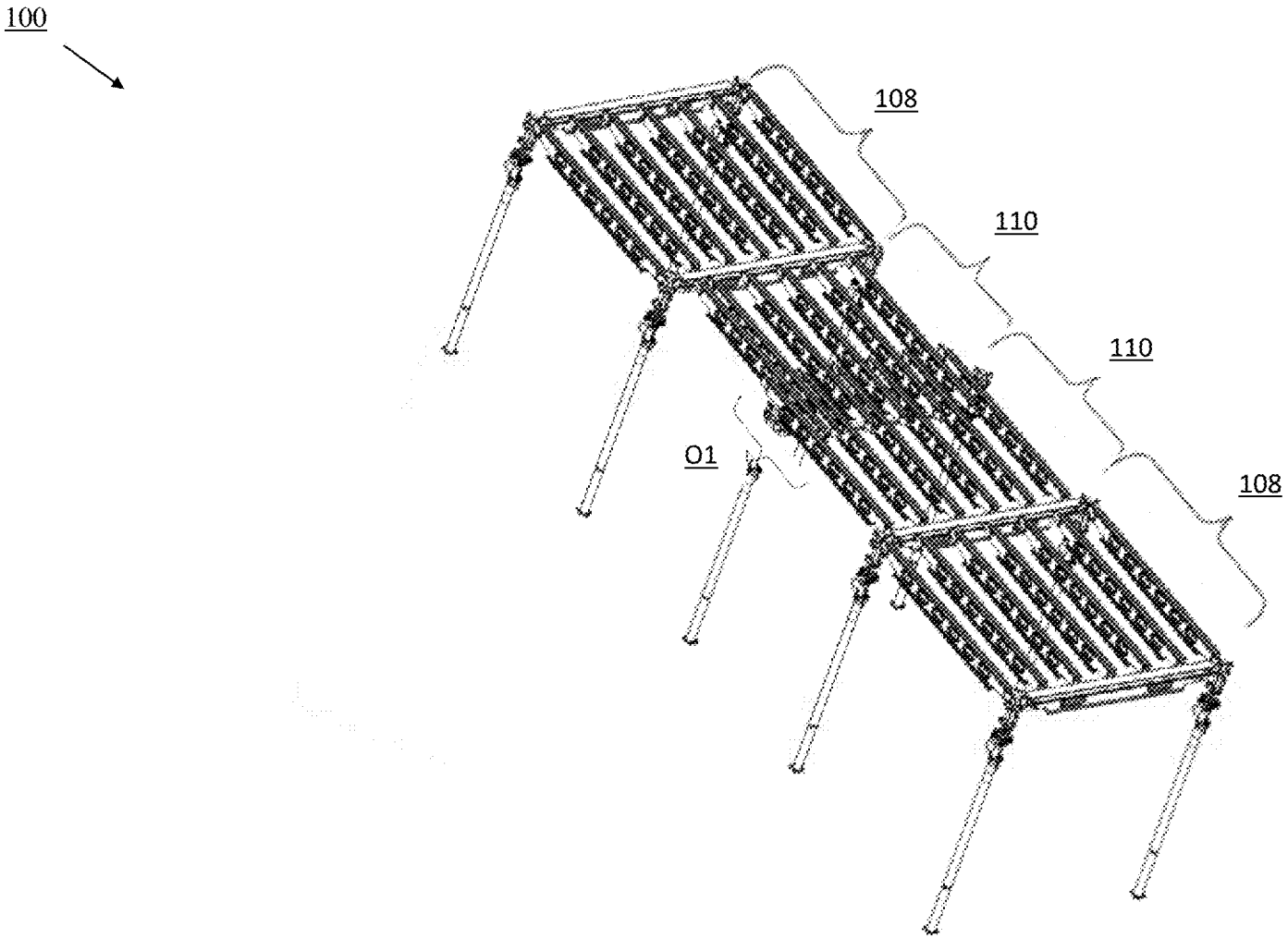
FIG. 9 illustrates another formwork with multiple standard grids and cantilever grids, according to an embodiment of the present disclosure.

Further, As shown in FIGS. 8A and 8B, the first formwork 100 also allows use of the cantilever grid concept 703 adjacent to wall locations 705 to form infill arrangements by using the same secondary beams 106 by passing over primary beams 104 which are kept at a lower-level hook of the multi-level drophead unit 102. On the other hand, as shown in FIG. 8C, the first formwork 100 may also be formed to achieve grids of non-standard size without the use of additional components. Such a grid can be achieved by varying the overlap of the secondary beam 106 over the primary beam 104. For instance, the secondary beams 106 can have an overhang O1 to achieve a predefined length of the first formwork 100.

Alternatively, the method may proceed to the step of mounting secondary beams 106B to the primary beams 104B and 104C using the erection aid. In one example, one of the double-walled end hook 106-12 of the secondary beam 106B is coupled to the lip 104-1 of the primary beam 104C and the other end of secondary beam 106B is coupled to the lip 104-1 of the primary beam 104B. Further, additional secondary beam 106B may be coupled to the primary beams 104B and 104C at a predetermined spacing therebetween. The predetermined spacing between the secondary beams 106B and the predetermined distances between the first prop 118A and second prop 118B, third prop 118C may be in accordance with a formwork table or a formwork chart.

Further, in order to create the second or cantilever grid 110, the method may include the step of coupling the primary beam 104A to the below level hook 134 of the multi-level drophead unit 102 on the fifth prop 118E and sixth prop 118F. Thereafter, one end of the secondary beams 106A may be placed on the top surface on the primary beam 104A and the other end of the secondary beams 106A may be coupled to the lips 104-1 on the second side of the primary beam 104B. Thereafter, the second sheathing member 114 may be placed on the secondary beam 106A to form the second grid.

Upon mounting the secondary beams 106B, the first sheathing member 112 may be placed to create the first grid. This method can be repeated for further grids in any direction.

In case the formwork is to be constructed to enable early striking without entrapment, the method may include additional steps. The method for erecting formwork 200 may include a step of mounting the secondary beam adapter 116 on the secondary beam 106C, such that the top surface 506 of the secondary beam adapter 116 is co-planar with the drophead adaptor 136 as shown in FIG. 2A. Thereafter, the first sheathing member 112 may be placed on the flanges 502-1 & 502-2 as shown in FIG. 4C.

On the other hand, the method for erecting a formwork 300 may also include the additional step of mounting the closure beam 301 in the groove 404-3 as shown in FIGS. 5A & 5B, such that the closure beam 301 rests on the top member 129 of the drophead 102 as shown in FIGS. 5A & 5B, the over the already placed first sheathing members 112 so that the flanges 602-1, 602-2 sits on the sheathing members on either side.

According to the present disclosure, the multi-level drophead units 102 with their corresponding hooks enable connection of different components to achieve both standard and cantilever grids 108 & 110 respectively without any additional components that is otherwise not possible from currently available conventional drophead units. Further, an increase in the multiple uses of the same equipment by way of the secondary beam adapter 116 and the closure beam 301 also reduces the time period of construction. In one instance, the secondary beam adapter 116 and the closure beam 301 may enable the disassembly of the standard grid without trapping the sheathing members 112, 114 after the lapse of few days of pouring uncured concrete instead of the general lapse time of 28 days.

The formwork grid system 100, 200, and 300 can also be disassembled or de-shuttered. A method disassembling the formwork grid system 100, 200, and 300 is explained from the next paragraph.

Referring now to FIGS. 1A and 3C, the wedge 121 of the drophead unit (102) is hammered which lowers the flyplate tube 126 along with the primary & secondary beams. Thereafter, an end of each of the plurality of secondary beams 106A of the cantilever grid 110 from the primary beam 104A. Similarly, the other end of the secondary beams 106A is decoupled from another primary beam 104B to dissemble the cantilever grid 110. Thereafter, the end of each of plurality of secondary beams 106B of the standard grid 110 are decoupled from the primary beam 104B and the ends are decoupled from the primary beam 104C to dissemble the standard grid 110.

Further, one end of primary beam 104A is decoupled from the third attachment portion 134 of the multi-level drophead unit 102. The same process is repeated one end of primary beam 104B is decoupled from the first attachment portion 134 of another multi-level drophead unit 102. Furthermore, one end of primary beam 104C is decoupled from the first attachment portion 134 of another multi-level drophead unit 102. Once the primary beam 104C is dismantled, ends of the secondary beam 106B is decoupled from the second attachment portions of the multi-level drophead units 102.

In the foregoing description, the multi-level drophead unit 100 and the prop 118 are connected using fasteners. The use of fasteners is a time consuming and labour-intensive task and results in the increase the overall time of construct the formwork 100. Moreover, the fasteners requires specialised and high precision tools, such as a wrench of size corresponding to the size of the fasteners. As a result, the operator is required to maintain inventory of fasteners as well as the tool. Such an issue can be addressed by the use of a quick fix clamp.

Figure 11A:
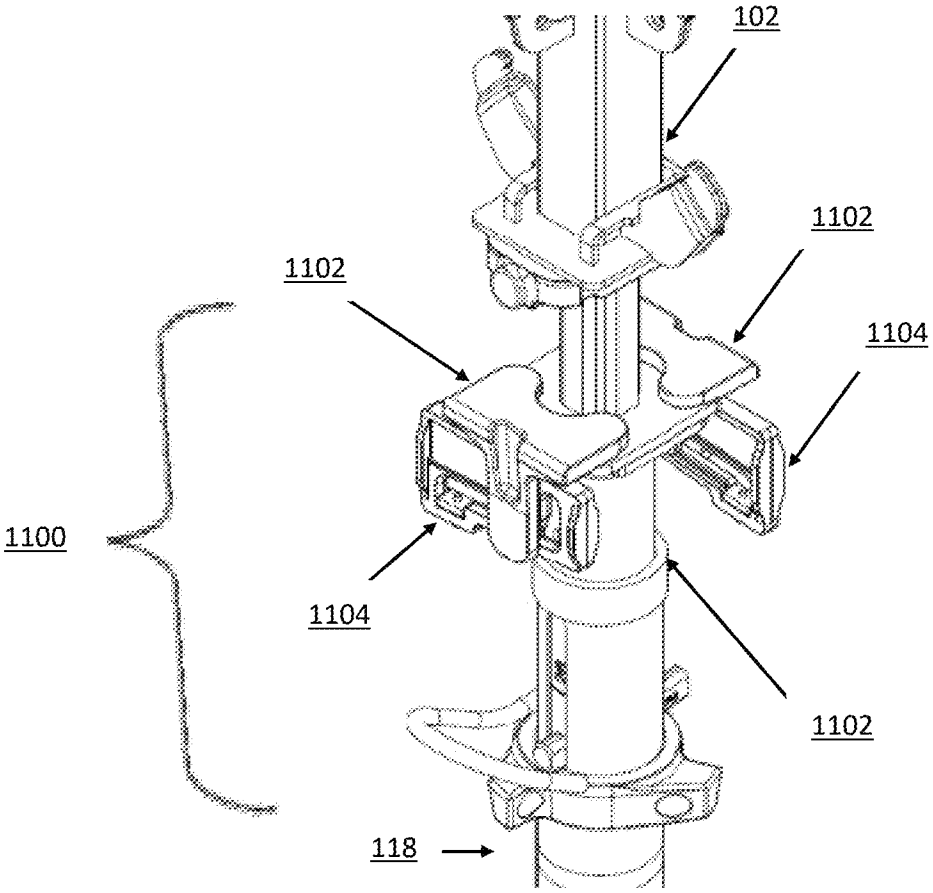
FIG. 11A shows a zoom in view showing the quick fix clamp 1100 securing the multi-level drophead unit to the prop, according to an embodiment of the present disclosure.
Figure 11B:
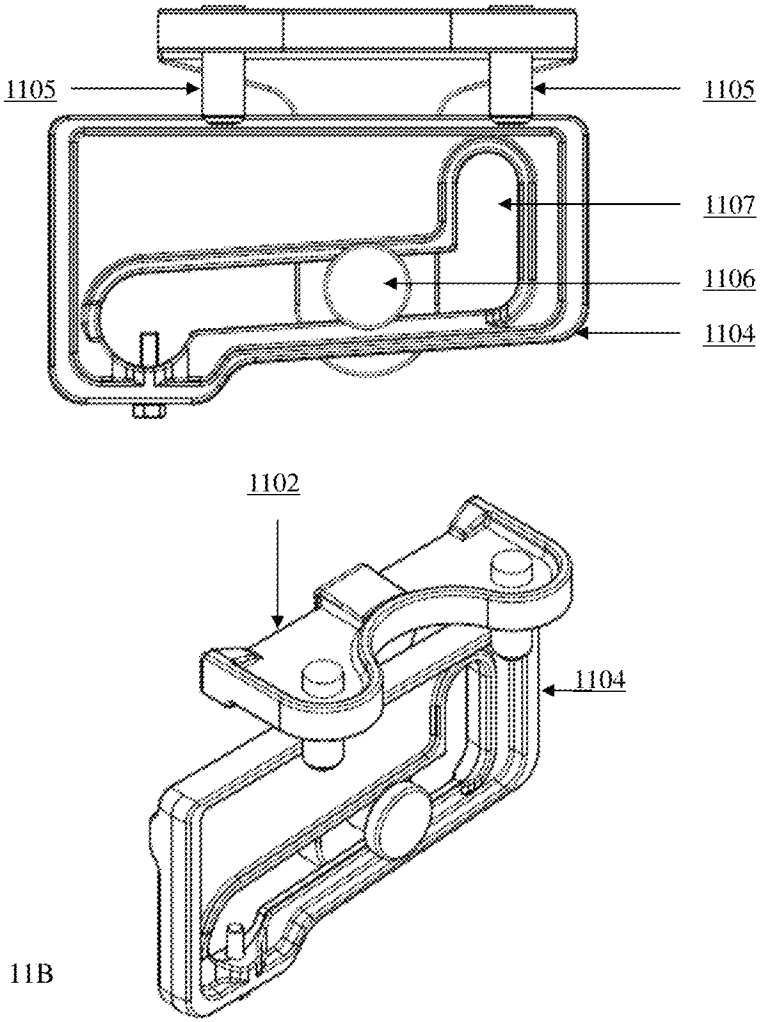
FIG. 11B shows various views of an assembled quick fix clamp, according to an embodiment of the present disclosure.
Figure 11B:
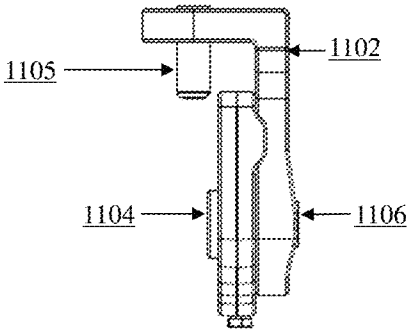
Figure 11B:
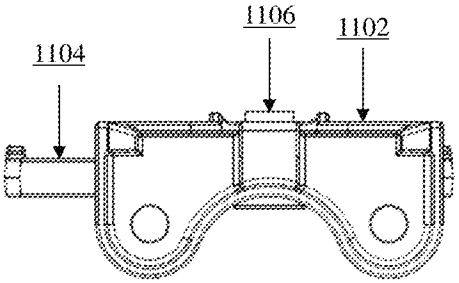
Figure 11C:
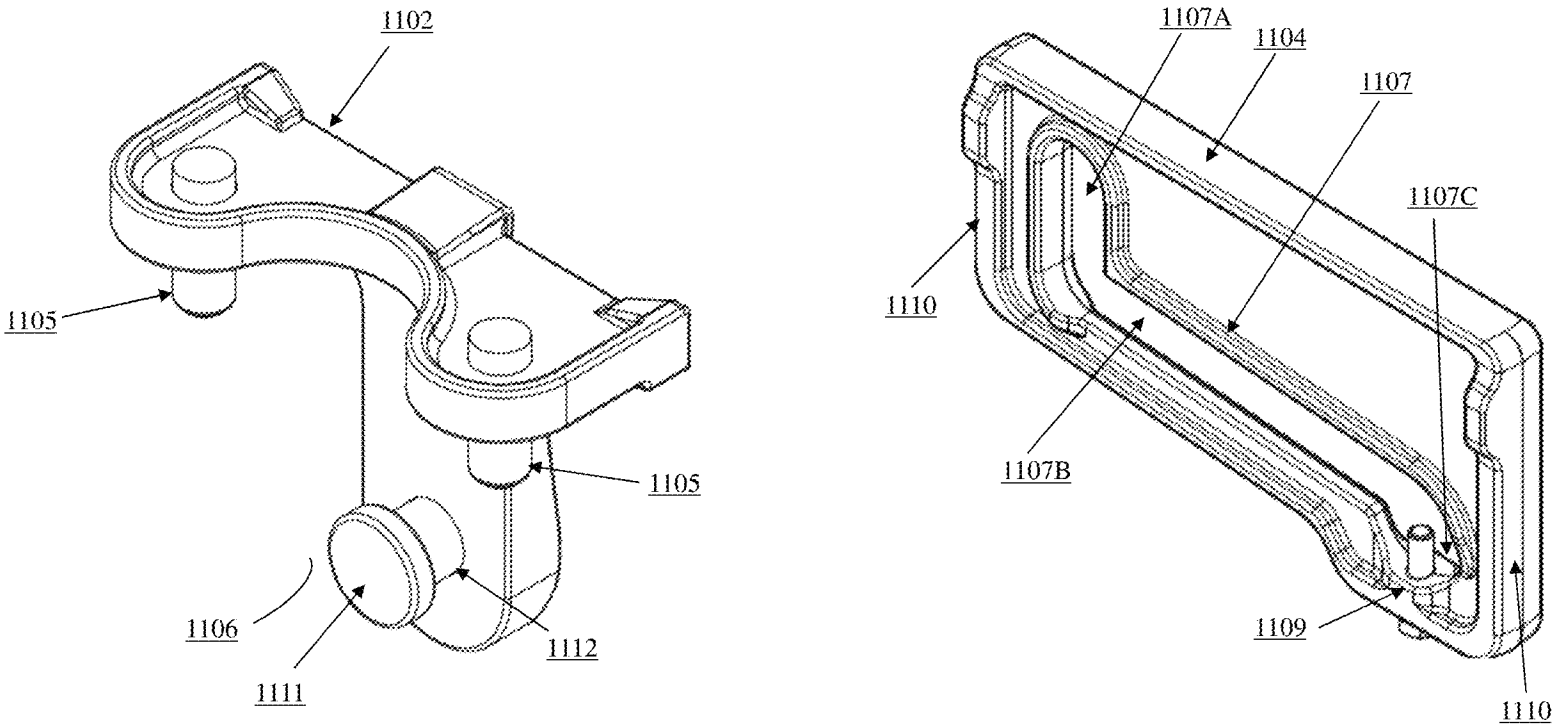
FIG. 11C shows an exploded view of the components of the quick fix clamp, according to an embodiment of the present disclosure.
Figure 11D:
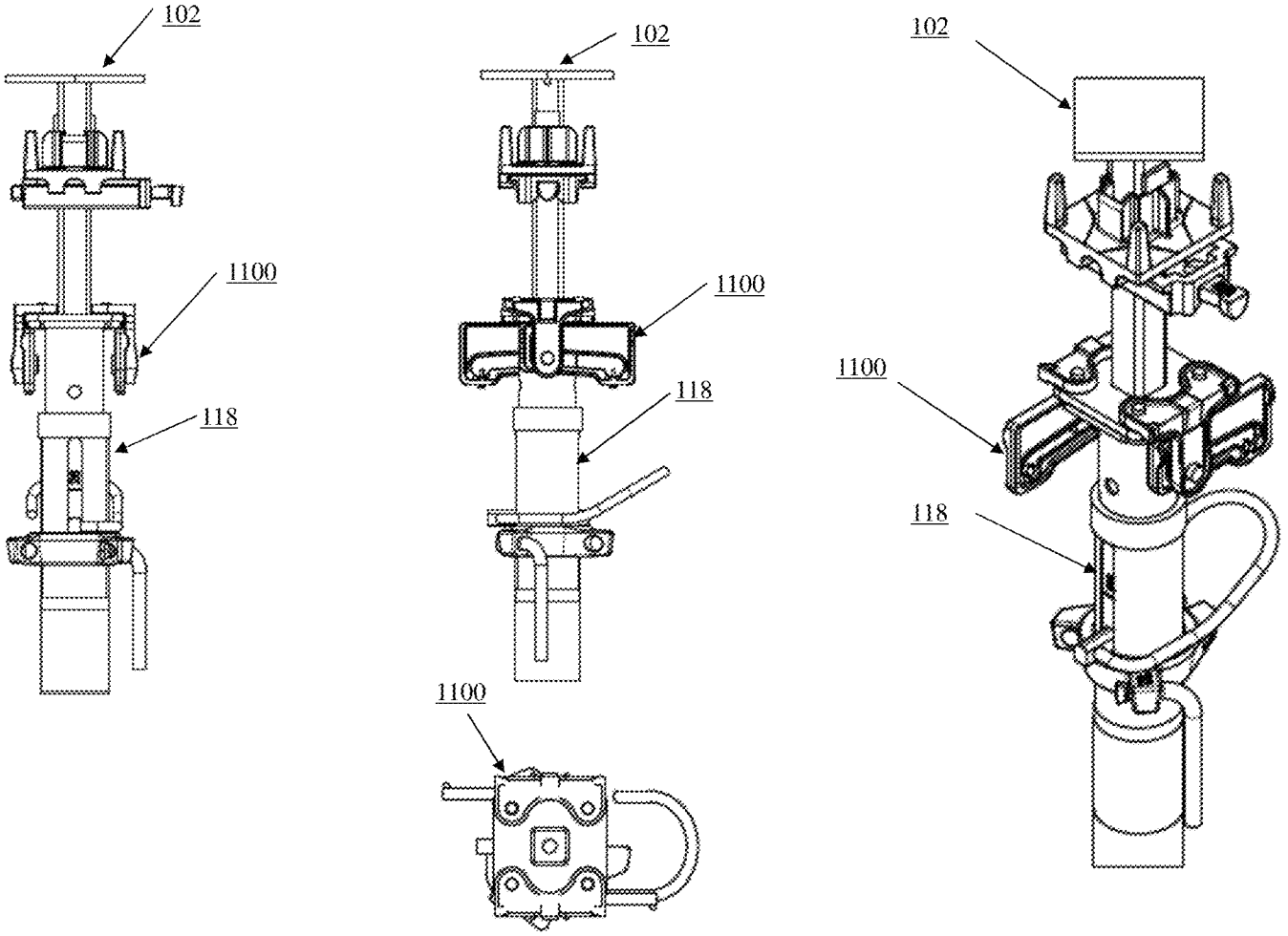
FIG. 11D shows different views the coupling between another type of drophead unit and prop using the quick fix clamp, according to an embodiment of the present disclosure.
Figure 11E:
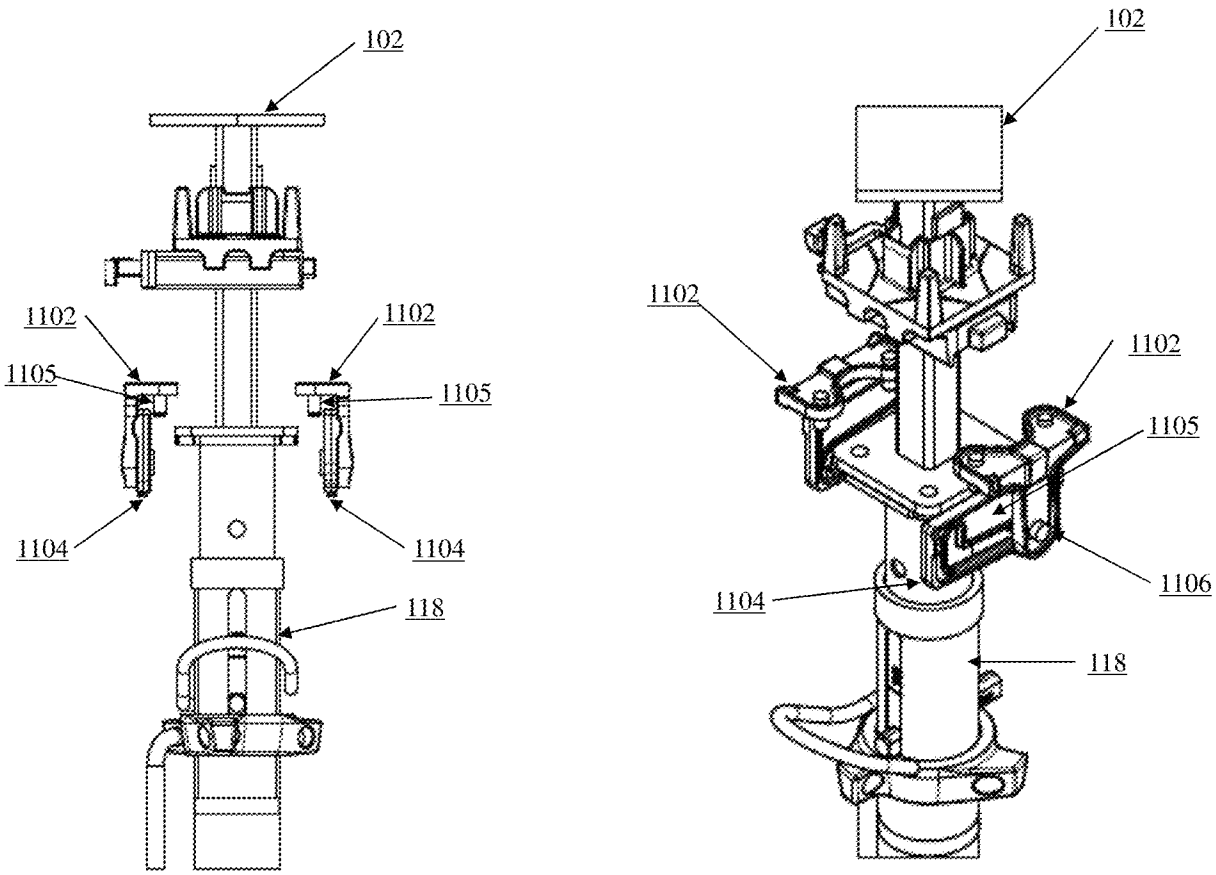
FIG. 11E to 11G shows steps of operating the quick fix clamp to secure the drophead unit to the prop, according to an embodiment of the present disclosure.
Figure 11F:
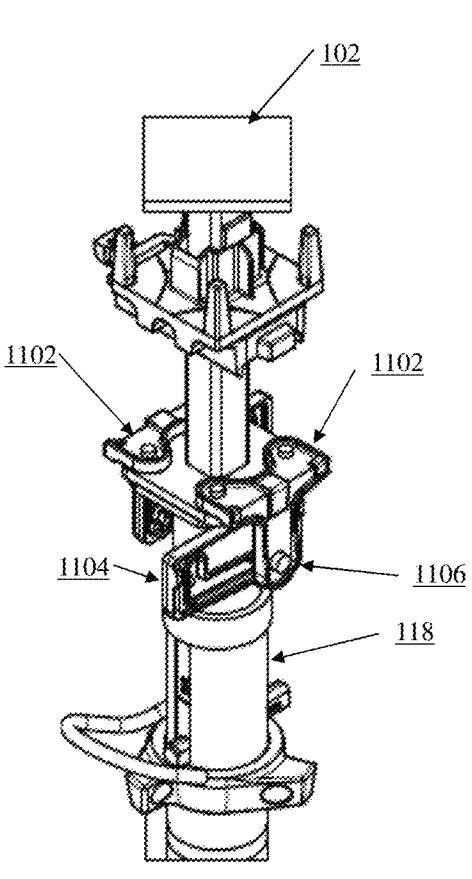
Figure 11F:
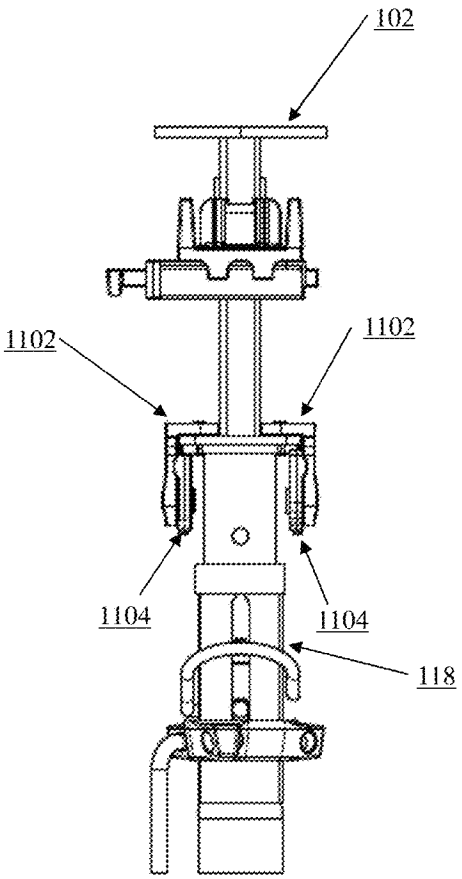
Figure 11G:
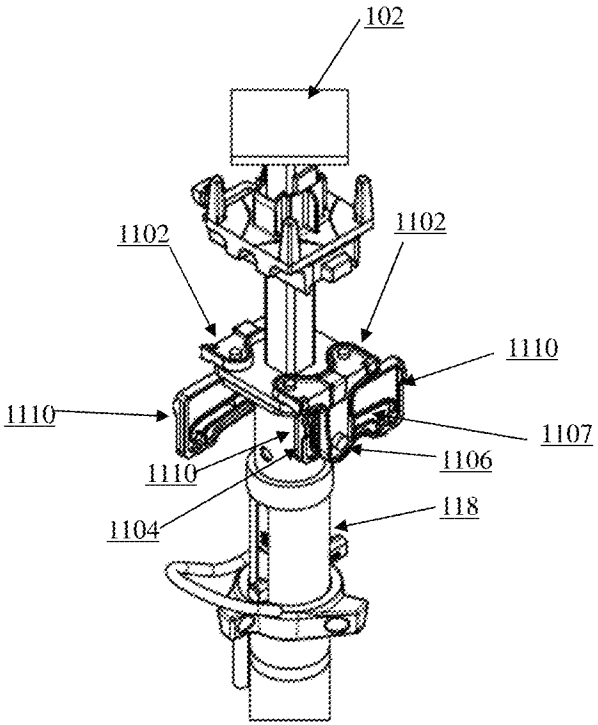
Figure 11G:
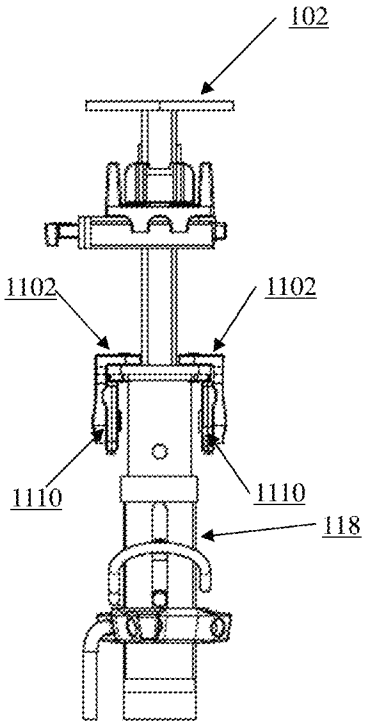

An exemplary embodiment of a quick fix clamp 1100 is shown in FIG. 11A to 11G. Specifically, FIG. 11A shows a zoom in view showing the quick fix clamp 1100 securing the multi-level drophead unit 102 to the prop 118. Further, FIG. 11B shows various views of an assembled quick fix clamp 1100 whereas FIG. 11C shows an exploded view of the components of the quick fix clamp 1100. Furthermore, FIG. 11D shows different views the coupling between a drophead unit and prop using the quick fix clamp 1100. Further, FIG. 11E to 11G shows steps of operating the quick fix clamp 1100 to secure the drophead unit 102 to the prop 118.

The quick fix clamp 1100 can be either a single piece unit or a pair of identical units. In either case, each unit of the quick fix clamp 1100 has a two-piece component design, namely a fast-engaging mechanism 1102 and a slider 1104. The fast-engaging mechanism 1102 may be formed as a top portion whereas the slider 1104 forms the bottom portion. The fast-engaging mechanism 1102 may include a pair of stub pins 1105 that connects the base plate 120 of the multi-level drophead 102 to the prop 118. The number of stub pins 1105 on the fast-engaging mechanism 1102 may be dependent on the number of holes in the drophead unit 102 and the prop 118. When installed, the stub pins 1105 prevent relative motion between the drophead unit 102 and the prop 118. The fast-engaging mechanism 1102 may also include a stud 1106 formed along a lower portion of the fast-engaging mechanism 1102. The stud 1106 has a wider head and thin shaft. During the installation, the stud 1106 move relative to the slider 1104. As shown in FIG. 11C, the fast-engaging mechanism 1102 may have a L-shaped profile such that the stub pins 1105 and the stud 1106 are orthogonal to each other.

In addition, the slider 1104 may include wedge profiled slot 1107 receives the stud 1106. According to the present disclosure, the stud 1106 slides inside the wedge profiled slot 1107 to vary a tautness between the multi-level drophead unit 102 the prop 118 when both of them are temporarily locked by the stub pins 1105. The wedge profiled slot 1107 may have different sections, namely, a first section 1107A, a second section 1107B, and 1107C. The first section 1107A may be vertical and extend along a portion of the height of the slide 1104. the first section 1107A is the portion in which the stud 1106 may rest when the quick fix clamp 1100 is not installed. Further, the first section 1107A has a top end and a bottom end. The top end is the end up to which the stud 1106 can travel and at which the quick fix clamp 1100 assumes its greatest height. On the other hand, the bottom end is the end through the stud 1106 between the first section 1107A and the second section 1107B. The second section 1107B has a descending inclination between the first section 1107A and the third section 1107C. The inclination results in the change in the overall height of the quick fix clamp 1100 when the studs 1106 travels through the second section 1107B. The change in height can result in tightening or loosening the quick fix clamp 1100. In the illustrated example, the width of the first section 1107A and the second section 1107B is less than a diameter of head of the stud 1106 so that the stud does not dislodge from the wedge profiled slot 1107.

The third section 1107C is formed at one of the ends of the slider 1104. The third section 1107C is connected to the second section 1107B and may have a width greater than the diameter of the stud 1106. The wider third section 1107C allows of the installation of the stud 1106 in the wedge 1107. The third section 1107C also includes a limiter 1109 bolted to the third section 1107C. The limiter 1109 is adapted to reduce the width of the third section 1107C to prevent dislodging of the stud 1106 from the third section 1107C once the stud 1106 is installed. The slider 1104 may also include headers 1110 on either side of the wedge profiled slot 1107. The headers 1110 allows the operator to hammer the slider 1104 to tighten or loosen the quick fix clamp 1100.

According to the present disclosure, the slider 1104 is operably coupled to the fast-engaging mechanism 1102 in such a way that the movement of the slider 1104 causes the fast-engaging mechanism 1102 to get tightened or loosened. Since the tightening or loosening can be done by simply sliding the slider 1104, the mounting or demounting of the multi-level drophead unit 102 on the prop 118 can be performed quickly that otherwise would not be possible in case of attaching the base plate 120 to the prop 118 using fasteners like bolts and nuts.

Referring now to FIG. 11E, the drophead unit 102 may be placed on the prop 118, such that holes of the base plate 120 and the props 118 are aligned. Thereafter, the quick fix clamp 1100 may be aligned, such that the stub pins 1105 are aligned with the holes. As clearly shown, a pair of two quick fix clamp 1100 is used. Once aligned, the stub pins 1105 are inserted in the holes as shown in FIG. 11F. Finally, the operator may hammer the header 1110 causing the stud 1106 to slide in the second section 1107B. The sliding of the stud 1106 reduces the height of the quick fix clamp 1100 resulting in the tightening of the quick fix clamp 1100. The operator may continue to hammer the header 1110 until maximum tautness is achieved and the stud 1106 stops sliding further. Once the stud 1106 stops sliding, the drophead unit 102 is secured to the prop 118 as shown in FIG. 11G.

The same process is reversed to disconnect the drophead unit 102 from the prop 118.

While specific language has been used to describe the present disclosure, any limitations arising on account thereto, are not intended. As would be apparent to a person in the art, various working modifications may be made to the method in order to implement the inventive concept as taught herein. The drawings and the foregoing description give examples of embodiments. Those skilled in the art will appreciate that one or more of the described elements may well be combined into a single functional element. Alternatively, certain elements may be split into multiple functional elements. Elements from one embodiment may be added to another embodiment.

The invention claimed is:

1. A formwork grid system, comprising:
- a plurality of props;
- a plurality of primary beams;
- a plurality of secondary beams; and
- a plurality of multi-level drophead units mounted on the plurality of props and adapted to couple to at least one of the plurality of primary beams and the plurality of secondary beams to form a first grid used as a platform to build a structure in an interior of a building, and a cantilever grid, the first grid having a first sheathing member, the cantilever grid having a second sheathing member, and each multi-level drophead unit of the plurality of multi-level drophead units comprising:
  - a base plate coupled to a prop from amongst the plurality of props;
  - a stem attached orthogonal to the base plate; and
  - a slidable flyplate slidably mounted on a portion of the stem, comprising:
    - a pair of first attachment portions formed on a periphery of the slidable flyplate and adapted to receive one of a primary beam of the plurality of primary beams and a secondary beam of the plurality of secondary beams, wherein the first sheathing member and the second sheathing member are adapted to form a horizontal surface over the primary beam and the secondary beam, and wherein the secondary beam comprises:
      - a body having a pair of top flanges extending along a longitudinal side of a profile and adapted to receive one of the first sheathing member and the second sheathing member;
      - a nailing insert extending along the longitudinal side of the profile and interposed between the pair of the top flanges;

a self-rotational lock adapted to insert into a cavity of the primary beam in a predefined orientation, wherein the self-rotational lock rotates from the predefined orientation inside the cavity to secure the self-rotational lock in the cavity;

a hook adjacent on the self-rotational lock and adapted to engage to a lip of the cavity; and a plurality of slots formed at predetermined gaps along the body of the secondary beam to hold the body, wherein each slot includes a polymer cap having projections; and a pair of flanges having second attachment portions and a pair of third attachment portions formed on the periphery of the slidable flyplate and adapted to receive one of the primary beam and the secondary beam, wherein the pair of first attachment portions and the second attachment portions are co-planar at a first level, and the pair of third attachment portions are positioned at a second level.

2. The formwork grid system of claim 1, wherein the first grid comprises:

a first primary beam from amongst the plurality of primary beams coupled to the multi-level drophead unit at the first level;

a second primary beam from amongst the plurality of primary beams coupled to another multi-level drophead unit of the plurality of multi-level drophead units at the first level; and an end-hook of the secondary beam installed in a cavity of the first primary beam and another end-hook of the secondary beam is installed in a cavity of the second primary beam.

3. The formwork grid system of claim 1, wherein the cantilever grid comprises:

a first primary beam from amongst the plurality of primary beams attached to the multi-level drophead unit at the first level;

a second primary beam from amongst the plurality of primary beams attached to another multi-level drophead unit of the plurality of multi-level drophead units at a lower level; and an end-hook of the secondary beam installed in a cavity of the first primary beam and another end of the secondary beam is placed on top of a lower primary beam of the plurality of primary beams, wherein an overhang of the secondary beam defines a length of the cantilever grid and a face of the end-hook of the secondary beam locks with an upper surface of the cavity.

4. The formwork grid system of claim 1, further comprising:

at least one secondary beam adapter positioned on a top surface of one of the plurality of secondary beams and adjacent to a drophead adaptor, wherein the at least one secondary beam adapter includes a first flange, a second flange, and a top surface, wherein the first flange and the second flange are adapted to receive a bottom surface of the first sheathing member.

5. The formwork grid system of claim 4, wherein a thickness of the at least one secondary beam adapter is in accordance with a thickness of the first sheathing member and the second sheathing member, such that selection of different thickness of the first sheathing member and the second sheathing member is enabled.

6. The formwork grid system of claim 1, further comprising:

at least one closure beam positioned on top of one of the plurality of primary beams, wherein the at least one closure beam includes at least one flange including a bottom surface adapted to rest on a top surface of one of the first sheathing member and the second sheathing member.

7. The formwork grid system of claim 6, wherein a thickness of the at least one closure beam is based on a thickness of the first sheathing member and the second sheathing member.

8. The formwork grid system of claim 1, wherein the primary beam comprises:

a cavity along longitudinal sides of the primary beam and adapted to receive an end-hook of the secondary beam;

a lip on each longitudinal side of the primary beam defining a boundary of the cavity; and a pair of double walled end hook on either end of the primary beam, and wherein each of the double walled end hook comprises:

a pair of horns spaced from each other to form a tapered gap there between to receive one of the pair of first attachment portions, the second attachment portions, and the pair of third attachment portions, wherein a width of the tapered gap at a bottom portion of the pair of horns is greater than a width of the tapered gap at a top portion of the pair of horns.

9. The formwork grid system of claim 8, each of the double walled end hook further comprising:

a pair of side walls having inner surface forming a cavity there between, adapted to receive a hook of the multi-level drophead unit, wherein the inner surface interacts with an outer wall of the hook of the multi-level drophead unit to prevent tilting of the primary beam with respect to the multi-level drophead unit; and a front wall extending from the ends of the pair of side walls and abuts with outer surface of a stabiliser tube of the multi-level drophead unit to prevent swaying of the primary beam with respect to the multi-level drophead unit.

* * * * *